US010978824B2

(12) United States Patent
Sato

(10) Patent No.: US 10,978,824 B2
(45) Date of Patent: Apr. 13, 2021

(54) CRIMP TERMINAL WITH RIDGE PORTION AND MANUFACTURING METHOD THEREOF

(71) Applicant: Yazaki Corporation, Tokyo (JP)

(72) Inventor: Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/420,528

(22) PCT Filed: Apr. 26, 2017

(86) PCT No.: PCT/JP2017/016500

§ 371 (c)(1),
(2) Date: May 23, 2019

(87) PCT Pub. No.: WO2018/123097

PCT Pub. Date: Jul. 5, 2018

(65) Prior Publication Data

US 2020/0044384 A1 Feb. 6, 2020

(30) Foreign Application Priority Data

Dec. 27, 2016 (JP) ..... JP2016-253774

(51) Int. Cl.
*H01R 4/10* (2006.01)
*H01R 13/40* (2006.01)
(Continued)

(52) U.S. Cl.
CPC ..... *H01R 13/5208* (2013.01); *H01R 4/184* (2013.01); *H01R 4/188* (2013.01)

(58) Field of Classification Search
CPC ..... H01R 4/185; H01R 4/20; H01R 4/188
(Continued)

(56) References Cited

U.S. PATENT DOCUMENTS 2,674,725 A * 4/1954 Buchanan ..... H01R 4/206 439/882
2,800,638 A * 7/1957 Hammell ..... H01R 4/00 439/882
(Continued)

FOREIGN PATENT DOCUMENTS

CN 105075021 A 11/2015
CN 105191001 A 12/2015
(Continued)

OTHER PUBLICATIONS

International Search Report for PCT/JP2017/016500 dated Jul. 18, 2017 (PCT/ISA/210).

*Primary Examiner* — Abdullah A Riyami
*Assistant Examiner* — Thang H Nguyen
(74) *Attorney, Agent, or Firm* — Sughrue Mion, PLLC

(57) ABSTRACT

The present invention suppresses the return of the barrel section while ensuring waterproofness against the contact portion with the aluminum core wire. A plurality of concave sections is dispersedly provided on the inner surface of the barrel section. A groove section is provided so as to overlap the sealing member. A ridge portion is provided extending in the crossing direction at a position which does not overlap with the sealing member in plan view and is close to the third region on the side opposite to the terminal section. The barrel section is crimped to the end portion by crimping so that the exposed portion of the aluminum core wire is in contact with the ridge portion, and is sealed with the sealing member.

7 Claims, 25 Drawing Sheets

(51) Int. Cl.
*H01R 13/52* (2006.01)
*H01R 4/18* (2006.01)

(58) Field of Classification Search
USPC ..... 439/877, 586
See application file for complete search history.

(56) References Cited

U.S. PATENT DOCUMENTS 3,956,823 A * 5/1976 Kuo ..... H01R 4/20 29/863
5,422,438 A * 6/1995 Lamome ..... H01R 4/203 174/76
6,056,605 A 5/2000 Nguyen et al.
6,514,102 B1 2/2003 Murakami et al.
8,882,549 B2 * 11/2014 Suzuki ..... H01R 4/188 439/882
8,974,258 B2 * 3/2015 Mitose ..... H01R 4/70 439/877
9,601,839 B2 3/2017 Sakaguchi
9,847,596 B2 * 12/2017 Sato ..... H01R 13/5216
10,665,964 B2 * 5/2020 Myer ..... H01R 4/184
2012/0094551 A1 * 4/2012 Corman ..... H01R 13/5221 439/877
2013/0045644 A1 * 2/2013 Aoki ..... H01R 4/183 439/878
2013/0095708 A1 * 4/2013 Mitose ..... H01R 43/005 439/878
2014/0220835 A1 * 8/2014 Seipel ..... H01R 4/185 439/877
2014/0273666 A1 * 9/2014 Corman ..... H01R 4/185 439/877
2016/0141768 A1 * 5/2016 Aoki ..... H01R 13/52 439/877
2017/0005417 A1 * 1/2017 Aoki ..... H01R 13/52

FOREIGN PATENT DOCUMENTS

JP 11-515137 A 12/1999
JP 3566541 B2 6/2004
JP 2009-230998 A 10/2009
JP 2012-59438 A 3/2012
JP 5480368 B2 4/2014
JP 2015-201269 A 11/2015
JP 2015-201459 A 11/2015
JP 5940198 B2 6/2016

* cited by examiner

CRIMP TERMINAL WITH RIDGE PORTION AND MANUFACTURING METHOD THEREOF

TECHNICAL FIELD

The present invention relates to an electric wire with terminal having a crimp terminal connected to a covered wire having an aluminum core wire and a terminal connection method for obtaining such a wire with terminal.

BACKGROUND ART

In recent years, covered electric wires having aluminum core wires have been used for wire harnesses in place of covered electric wires having copper core wires. At this time, for example, some crimp terminals such as connector terminals are made of a copper alloy or the like, and the surface thereof is tin-plated or gold-plated. When crimp terminals of this type are crimped to the end portions of the covered electric wires where the aluminum core wires are exposed, contact between dissimilar metals occurs between the aluminum core wires and the crimping barrel section of the crimp terminal. If moisture adheres to such a contact portion, there is a possibility that the aluminum core made of aluminum, which is a base metal, is corroded due to so-called dissimilar metal corrosion.

Therefore, there has been proposed a crimp terminal surrounded by a sealing member around the contact portion between the barrel section and the aluminum core wire (see, for example, Patent Literature 1 and Patent Literature 2). According to such type of crimp terminal, moisture can be prevented from entering the contact portion of dissimilar metals, and generation of dissimilar metal corrosion as described above can be avoided.

FIG. 29 is a view showing an example of a conventional crimp terminal surrounding the contact portion between the barrel section and the aluminum core wire with a sealing member.

The crimp terminal 9 shown in FIG. 29 comprises a barrel section 91 and a terminal section 92, which are made of a metal plate such as a copper alloy by sheet metal working and subjected to tin plating or gold plating on the surface, and are arranged in the axial direction D91. The barrel section 91 is a portion that is wound around and crimped on the end portion W9*a* of the covered electric wire W9 having the aluminum core wire W91, the aluminum core wire W91 being exposed. The terminal section 92 is a female terminal connected to a pin terminal (not shown) as a connection object.

The barrel section 91 has a structure in which the metal plate is bent so that the cross section that intersects with the axial direction D91 is substantially U-shaped. After the end portion W9*a* of the covered electric wire W9 is placed on the inner surface 911 of the barrel section 91, the barrel section 91 is wound around the end portion W9*a* and crimped. A part of the inner surface 911 of the barrel section 91 is a contact portion 911*a* with the aluminum core wire W91 at the end portion W9*a*.

In the contact portion 911*a*, a serration 94 is formed in which a plurality of rows of grooves extending in an crossing direction D92 crossing the axial direction D91 in the plan view with respect to the contact portion 911*a* are arranged in the axial direction D91. When the barrel section 91 is wound around the end portion W9*a* and crimped, the edge of each groove forming the serration 94 bites into the aluminum core wire W91, so that satisfactory conduction between the covered electric wire W9 and the crimp terminal 9 can be obtained.

A sealing member 93 is provided so as to surround the contact portion 911*a*. When the barrel section 91 is wound around the end portion W9*a* and crimped, the sealing member 93 seals the gaps around the contact portion 911*a* and prevents moisture from entering.

PRIOR ART DOCUMENT

Patent Literature

Patent Literature 1: JP 5480368 B
Patent Literature 2: JP 5940198 B

SUMMARY OF INVENTION

Technical Problem

Here, in the case of the wire with terminal in which the crimp terminal as described above is crimped to the end portion of the covered electric wire, in many cases, a force tending to return to the original state against the crimping acts on the barrel section of the crimp terminal. At this time, the sealing member wound around the end portion of the covered electric wire together with the barrel section sometimes works to promote this return. Such a large return may cause deterioration in conductivity between the aluminum core wire and the crimp terminal in the wire with terminal, a reduction in crimping strength between the end portion of the covered wire and the crimp terminal, and the like.

Accordingly, an object of the present invention is to provide an electric wire with terminal capable of suppressing the return of the barrel section while securing waterproofness against a contact portion with an aluminum core wire, and a terminal connection method for obtaining such a wire with terminal.

Solution to Problem

According to a first aspect of the present invention, there is provided an electric wire with terminal of which an end portion is connected to a crimp terminal in which a barrel section to be wound around and crimped to an end portion of a covered electric wire having an aluminum core wire at which the aluminum core wire is exposed, and a terminal section to be connected to a connection object are arranged in a predetermined axial direction, wherein the barrel section includes: a bottom plate section extending in the axial direction, on which the end portion of the covered electric wire is to be placed; and an inner barrel piece and an outer barrel piece extending from the bottom plate section on both sides in a crossing direction intersecting the axial direction in plan view with respect to the bottom plate section, wherein a sealing member formed of an adhesive gel is affixed across a first region that longitudinally traverses the outer barrel piece in the axial direction, a second region which traverses the inner surface in the crossing direction at a position close to the terminal section, and a third region that traverses the inner surface in the crossing direction so as to intersect a covered portion of the end portion, wherein a plurality of concave sections is dispersedly provided on an inner surface of the barrel section, a groove section is provided on at least the third region so as to overlap the sealing member, and a ridge portion is provided extending in the crossing direction at a position which does not overlap with the sealing member in plan view and is close to the third region, wherein the barrel section is crimped to the end portion by crimping so that the exposed portion of the aluminum core wire at the end portion is in contact with the ridge portion, and the sealing member seals between the inner barrel piece and the outer barrel piece, an opening of the barrel section which is to be cylindrical on a side of the terminal section, and between the covered portion and the barrel section.

In the electric wire with terminal of the present invention, the edge of each recess provided on the inner surface of the barrel section bites into the aluminum core wire by crimping, so that satisfactory conduction between the covered electric wire and the crimp terminal can be obtained. In the wire with terminal of the present invention, the sealing member is formed by an adhesive gel, and affixed to the inner surface of the barrel section, so that after crimping, the sealing member seals between the inner barrel piece and the outer barrel piece, an opening of the barrel section which is to be cylindrical on a side of the terminal section, and between the covered portion and the barrel section. This sealing member ensures waterproofness against the above-mentioned contact portion between the aluminum core wire and the inner surface of the barrel section.

Here, in the electric wire with terminal of the present invention, in order to make the exposed portion of the aluminum core wire come into contact with the ridge portion extending in the crossing direction at a position not overlapping the sealing member and at a position close to the third region, the barrel section is crimped to the end of the covered electric wire. The ridge portion extending in the crossing direction described above plays a role of resisting the return of the barrel after crimping. At this time, if the sealing member made of the flexible adhesive gel temporarily overlaps with the protruding portion and is wound around the end portion, it becomes a cushion at the time of crimping to widen the winding diameter at the ridge, and the above-mentioned role of the ridge portion may be weakened in some cases. However, in the wire with terminal of the present invention, since the exposed portion of the aluminum core wire is crimped to the above-mentioned ridge, the ridge portion comes into direct contact with the aluminum core wire without interposing the sealing member therebetween. Thereby, the ridge portion can resist the return of the barrel section without being affected by the sealing member. Further, since the ridge portion is wound without interposing the cover of the covered electric wire therebetween, the winding diameter is also suppressed by the thickness of the coating. Even in this point, it is possible to satisfactorily resist the return of the barrel section. As a result, the return of the barrel section is favorably suppressed. Thus, according to the wire with terminal of the present invention, it is possible to suppress the return of the barrel section while securing the waterproof property against the contact portion with the aluminum core wire. Further, since the ridge portion is in contact with the exposed portion of the aluminum core wire, the conductivity between the crimp terminal and the aluminum core wire can be improved.

Here, preferably, the inner surface of the barrel section is further provided with a second ridge portion extending in the crossing direction at a position close to the terminal section.

According to this preferable electric wire with terminal, it is possible to satisfactorily suppress the return of the barrel section at both the terminal section side of the barrel section and the opposite side thereof.

Further, in the electric wire with terminal of the present invention, it is preferable that the ridge portion is an indent portion formed so as to protrude from the inner surface of the barrel section. Likewise, in the above-described preferred wire with terminal provided with the second ridge portion of the barrel section close to the terminal section, it is more preferable that the second ridge portion may be indented so as to protrude from the inner surface of the barrel section.

According to these preferable electric wires with terminal, since the resistance against the return as described above is strong in the ridge portion and the second ridge portion as the indent portions, the return of the barrel section can be more satisfactorily suppressed.

Further, in the electric wire with terminal of the present invention, preferably, the barrel section is crimped to the end portion so that a tip of the covered portion at the end portion overlaps a portion of the sealing member affixed to the third region.

According to this preferred electric wire with terminal, the ridge portion is provided as close as possible to the third region and is brought into contact with the exposed portion of the aluminum core wire, so that it is possible to more effectively suppress the return at a position close to the end edge of the barrel section.

Further, in the electric wire with terminal of the present invention, it is also preferable that the barrel section is crimped to the end portion so that a tip of the aluminum core wire at the end portion overlaps with a portion of the sealing member affixed to the second region.

According to this preferable electric wire with terminal, a portion even slightly deviated in the above-mentioned axial direction from the portion affixed to the second region of the sealing member can immediately contribute to electrical conduction with the aluminum core wire. As a result, the conductivity between the aluminum core wire and the crimp terminal can be sufficiently secured.

According to a second aspect of the present invention, there is provided a terminal connection method for connecting a crimp terminal to an end portion of a covered electric wire, the crimp terminal in which a barrel section to be wound around and crimped to the end portion of the covered electric wire having an aluminum core wire at which the aluminum core wire is exposed, and a terminal section to be connected to a connection object are arranged in a predetermined axial direction, wherein the barrel section includes: a bottom plate section extending in the axial direction, on which the end portion of the covered electric wire is to be placed; and an inner barrel piece and an outer barrel piece extending from the bottom plate section on both sides in a crossing direction intersecting the axial direction in plan view with respect to the bottom plate section, wherein a sealing member formed of an adhesive gel is affixed across a first region that longitudinally traverses the outer barrel piece in the axial direction, a second region which traverses the inner surface in the crossing direction at a position close to the terminal section, and a third region that traverses the inner surface in the crossing direction so as to intersect a covered portion of the end portion, wherein a plurality of concave sections is dispersedly provided on an inner surface of the barrel section, a groove section is provided on at least the third region so as to overlap the sealing member, and a ridge portion is provided extending in the crossing direction at a position which does not overlap with the sealing member in plan view and is close to the third region, the method comprising:

a placing step of placing the end portion on the inner surface of the barrel section along the axial direction so that an exposed portion of the aluminum core wire at the end portion is in contact with the ridge portion; and a crimping step of fixing the crimp terminal to the end portion by winding the barrel section around the end portion with the inner barrel piece arranged inside and by crimping, and sealing between the inner barrel piece and the outer barrel piece, an opening of the barrel section which is to be cylindrical on a side of the terminal section, and between the covered portion and the barrel section with the sealing member.

According to the terminal connecting method of the present invention, the barrel section to which the sealing member is affixed is wound around the end portion of the covered electric wire and crimped, whereby waterproofness against the above-mentioned contact portion between the aluminum core wire and the inner surface of the barrel portion is secured. Then, by crimping so that the exposed portion of the aluminum core wire is brought into contact with the above-mentioned ridge portion, the ridge portion can satisfactorily suppress return of the barrel section without being affected by the sealing member or the covered portion. As described above, according to the terminal connecting method of the present invention, it is possible to suppress the return of the barrel portion while securing the waterproof property against the contact portion with the aluminum core wire.

Further, in the terminal connection method of the present invention, preferably, the placing step is a step of placing the end portion on the inner surface of the barrel section so that a tip of the covered portion at the end portion overlaps with a portion of the sealing member affixed to the third region.

According to this preferable terminal connecting method, the ridge portion is provided as close as possible to the third region and is brought into contact with the exposed portion of the aluminum core wire, so that it is possible to more effectively suppress the return at a position close to the end edge of the barrel section.

Further, in the terminal connection method of the present invention, it is preferable that the placing step may be to place the end portion on the inner surface of the barrel section such that the tip of the aluminum core wire at the end portion overlaps with a portion of the sealing member affixed to the second region.

According to this preferable terminal connection method, a portion even slightly deviated in the above-mentioned axial direction from the portion affixed to the second region of the sealing member can immediately contribute to electrical conduction with the aluminum core wire. As a result, the conductivity between the aluminum core wire and the crimp terminal can be sufficiently secured.

Although only the mode related to the basic form of the terminal manufacturing method of the present invention has been described here, it goes without saying the preferred form of the above-mentioned wire with terminal of the present invention is applied as a suitable form for the terminal manufacturing method of the present invention.

Effect of the Invention

According to the present invention, it is possible to obtain an electric wire with terminal capable of suppressing the return of the barrel section while securing waterproofness against a contact portion with an aluminum core wire, and a terminal connection method for obtaining such a wire with terminal.

DESCRIPTION OF EMBODIMENTS

Hereinafter, one embodiments of the present invention will be described with appropriate modifications.

Figure 1:
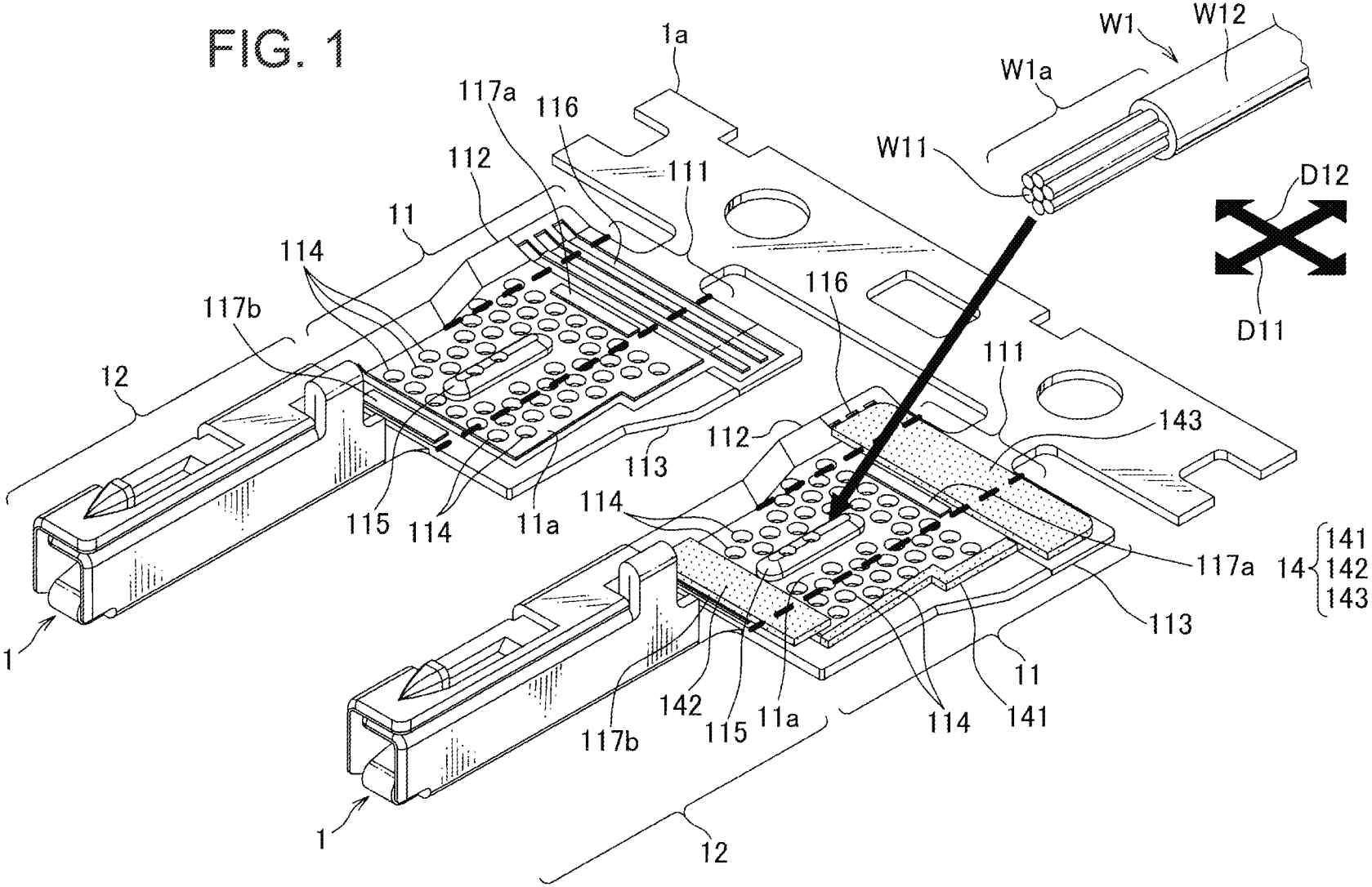
FIG. 1 is an explanatory view for explaining a crimp terminal according to one embodiment of the present invention.

FIG. 1 is an explanatory view for explaining a crimp terminal according to one embodiment of the present invention.

A crimp terminal 1 according to the present embodiment is crimped to an end portion W1*a* of a covered electric wire W1 exposing an aluminum core wire W11. The crimp terminal 1 includes a barrel section 11, a terminal section 12, and a seal member 14. Although two crimp terminals 1 are shown in FIG. 1, one crimp terminal 1 is shown with the seal member 14 removed so that an inner surface shape of the barrel section 11 can be visually observed.

The barrel section 11 and the terminal section 12 are made from a metal plate such as a copper alloy by punching and sheet metal working, and its surface is subjected to tin plating or gold plating. The barrel section 11 and the terminal section 12 are arranged in a predetermined axial direction D11. Here, in the present embodiment, the barrel section 11 and the terminal section 12 are collectively formed in a state in which a plurality of crimp terminals 1 are connected by a strip-like connecting piece 1*a*. The barrel section 11 is a plate-like portion wound and wound around the end portion W1*a* of the covered electric wire W1 so as to wrap around the aluminum core wire W11 and the covered portion W12 in a circumferential direction. In the present embodiment, the barrel section 11 is core-cover integral barrel in which a portion enclosing the aluminum core wire W11 and a portion enclosing the covered portion W12 are integrated. The terminal section 12 is a square tubular female terminal connected to a pin terminal (not shown) as a connection object.

The barrel section 11 has a bottom plate section 111, an inner barrel piece 112, and an outer barrel piece 113. The bottom plate section 111 extends in the above-mentioned axial direction D11. The inner barrel piece 112 and the outer barrel piece 113 extend from the bottom plate section 111 on both sides in a crossing direction D12 intersecting the axial direction D11 in plan view with respect to the bottom plate section 111. When crimping the end portion W1*a* of the covered electric wire W1, the barrel section 11 is wound around the end portion W1*a* with the inner barrel piece 112 inside and the outer barrel piece 113 outside as described later.

Here, a plurality of concave sections 114 is dispersedly provided on an inner surface 11*a* of the barrel section 11. Each concave section 114 is formed in a circular shape in plan view with respect to the inner surface 11*a* of the barrel section 11. Further, a convex section 115 is formed on the bottom plate section 111 of the barrel section 11 by press working from an outer surface side at a position where the aluminum core wire W11 at the end portion W1*a* of the covered electric wire W1 is placed. A part of the plurality of concave sections 114 is also formed on the convex section 115.

A seal member 14 formed of an adhesive gel sheet is affixed to the inner surface 11*a* of the barrel section 11 so as to surround the plurality of concave sections 114 from three sides in a plan view. The seal member 14 is affixed as follows. Incidentally, examples of the adhesive gel sheet include, for example, those using acrylic adhesives, but the present invention is not limited thereto.

Figure 2:
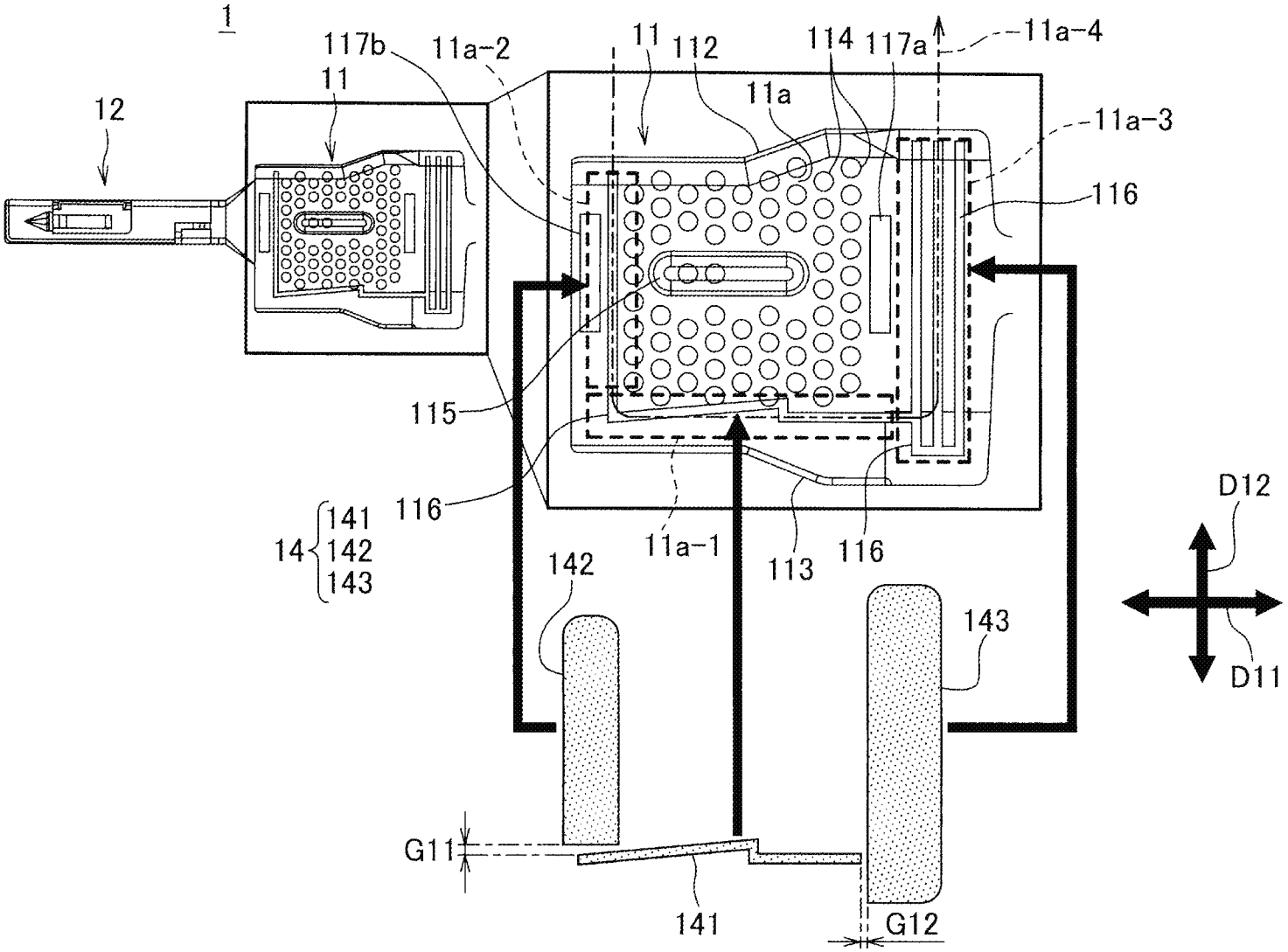
FIG. 2 is a schematic view showing how the seal member shown in FIG. 1 is affixed to an inner surface of a barrel section.

FIG. 2 is a schematic view showing how the seal member shown in FIG. 1 is affixed to the inner surface of the barrel section.

The sealing member 14 is formed of an adhesive gel sheet and is arranged over three regions of the first region 11*a*-1, the second region 11*a*-2, and the third region 11*a*-3 on the inner surface 11*a* of the barrel section 11. The first region 11*a*-1 is a region that longitudinally traverses the outer barrel piece 113 in the axial direction D11. The second region 11*a*-2 is an area that traverses the inner surface 11*a* in the crossing direction D12 closer to the terminal section 12. The third region 11*a*-3 is an area traversing the inner surface 11*a* in the crossing direction D12 so as to intersect the covered portion W12 of the end portion W1*a*.

As shown in FIGS. 1 and 2, in the present embodiment, the seal member 14 is composed of three portions, a first seal portion 141, a second seal portion 142, and a third seal portion 143. The first seal portion 141 extends in a band shape in the axial direction D11 in the first region 11*a*-1. The second seal portion 142 extends in a band shape in the crossing direction D12 in the second region 11*a*-2. The third seal portion 143 extends in a band shape in the crossing direction D12 in the third region 11*a*-3.

In the present embodiment, groove sections 116 are formed on the inner surface 11*a* of the barrel section 11 so as to overlap the sealing member 14 in the first region 11*a*-1, the second region 11*a*-2, and the third region 11*a*-3. In the first region 11*a*-1, one groove section 116 extends in the axial direction D11 while bending in a sawtooth shape in the middle. In the second area 11*a*-2, one groove section 116 extends linearly in the crossing direction D12, in the third area 11*a*-3, three grove sections 116 extend linearly in the crossing direction D12, and on a side of the first area 11*a*-1, they are joined together. Further, the plurality of concave portions 114 is provided avoiding the groove sections 116.

Furthermore, in the present embodiment, on the inner surface 11*a* of the barrel section 11, a first indent portion 117*a* is provided as a ridge extending in the crossing direction D12 at a position closer to the center than the third region 11*a*-3 in plan view. Further, a second indent portion 117*b* is provided as a ridge extending in the crossing direction D12 at a position closer to the terminal section 12 than the groove section 116 and partially overlapping with the second region 11*a*-2.

In the present embodiment, the seal member 14 is attached in a state of being divided in a halfway of a path 11*a*-4 extending from the second region 11*a*-2 through the first region 11*a*-1 to the third region 11*a*-3. Specifically, the seal member 14 is attached in a state where both the second seal portion 142 and the third seal portion 143 are separated from the first seal portion 141. The second seal portion 142 is attached in a state where the second seal portion 142 is separated from the first seal portion 141 across the path 11*a*-4 in the axial direction D11. On the other hand, the third seal portion 143 is attached to the first seal portion 141 in a state where the third seal portion 143 crosses the path 11*a*-4 in the crossing direction D12. A slight gap G11 opens between the second seal portion 142 and the first seal portion 141, and a slight gap G12 opens between the third seal portion 143 and the first seal portion 141.

Here, the second seal portion 142 of the seal member 14 to be affixed to the second region 11*a*-2 is formed in a belt shape with a wide width so that a part thereof is extruded from the opening of the cylindrical barrel portion 11 after the crimping. On the other hand, the first seal portion 141 affixed to the first region 11*a*-1 is narrower than the second seal portion 142 and formed in a shape corresponding to the groove section 116 in the first region 11*a*-1. Specifically, the first seal portion 141 is formed to have approximately the same width and substantially the same shape as the groove section 116 so as to be accommodated inside the groove section 116. The third seal portion 143 affixed to the third region 11*a*-3 is formed in a band shape slightly wider than the second seal portion 142.

The first seal portion 141, the second seal portion 142, and the third seal portion 143 are affixed so that they respectively overlap the first region 11*a*-1, the second region 11*a*-2, and the third region 11*a*-3 of the groove section 116. In particular, regarding the first seal portion 141, as described above, the first seal portion 141 is affixed so as to be accommodated inside the groove section 116.

The crimp terminal 1 described above is manufactured as follows.

Firstly, a sheet metal working step of forming a structure before attachment of the seal member 14 is performed. In the sheet metal working step, the barrel section 11 is formed from a metal plate together with the terminal section 12. As described above, in the present embodiment, in the sheet metal working process, the barrel section 11 and the terminal section 12 are collectively formed in a state in which a plurality of crimp terminals 1 are connected by the strip-like connecting piece 1*a*. In this sheet metal working step, formation of a plurality of concave sections 114, formation of convex sections 115, and formation of groove sections 116 on the inner surface 11*a* of the barrel section 11 are also performed.

Subsequently, the seal member 14 is formed with an adhesive gel sheet, and the seal member affixing step of affixing the seal member 14 over the first area 11*a*-1, the second area 11*a*-2, and the third area 11*a*-3 is performed. In this the seal member affixing step, the seal member 14 is affixed in a state where the seal member 14 is divided in a halfway of the path 11*a*-4 from the second region 11*a*-2 to the third region 11*a*-3 via the first region 11*a*-1. That is, the first seal portion 141, the second seal portion 142, and the third seal portion 143 are individually affixed to the inner surface 11*a* of the barrel section 11.

In addition, in the sealing member affixing step, the first seal portion 141, the second seal portion 142, and the third seal portion 143 are punched out from the adhesive gel sheet and affixed to the inner surface 11*a* of the barrel section 11. By pushing the adhesive gel sheet toward each of the affixing points on the inner surface 11*a* of the barrel section 11 while punching out the adhesive gel sheet with the die punching cutter of each seal portion, punching out and affixing are performed substantially at the same time. At this time, the second seal portion 142 is affixed so as to overlap with a part of the second indent portion 117*b*, and the third seal portion 143 is affixed so as to expose the first indent portion 117*a*.

The crimp terminal 1 manufactured in this manner is crimped to the end portion W1*a* of the covered electric wire W1 by the following terminal connection method.

Figure 3:
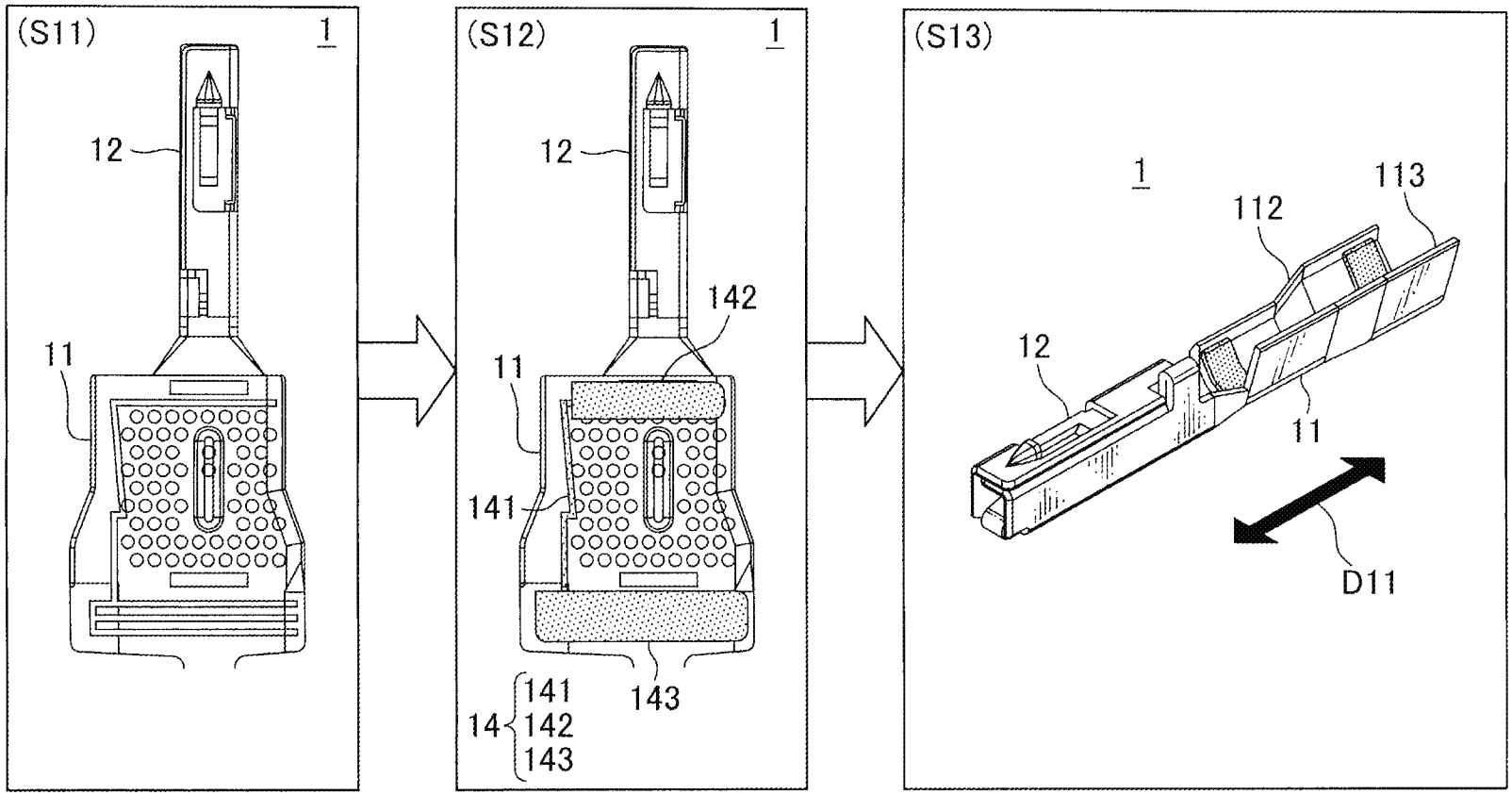
FIG. 3 is a view showing a procedure until preparations are made for crimping the crimp terminal shown in FIGS. 1 and 2 to an end portion of a covered electric wire with a terminal connecting method.
Figure 4:
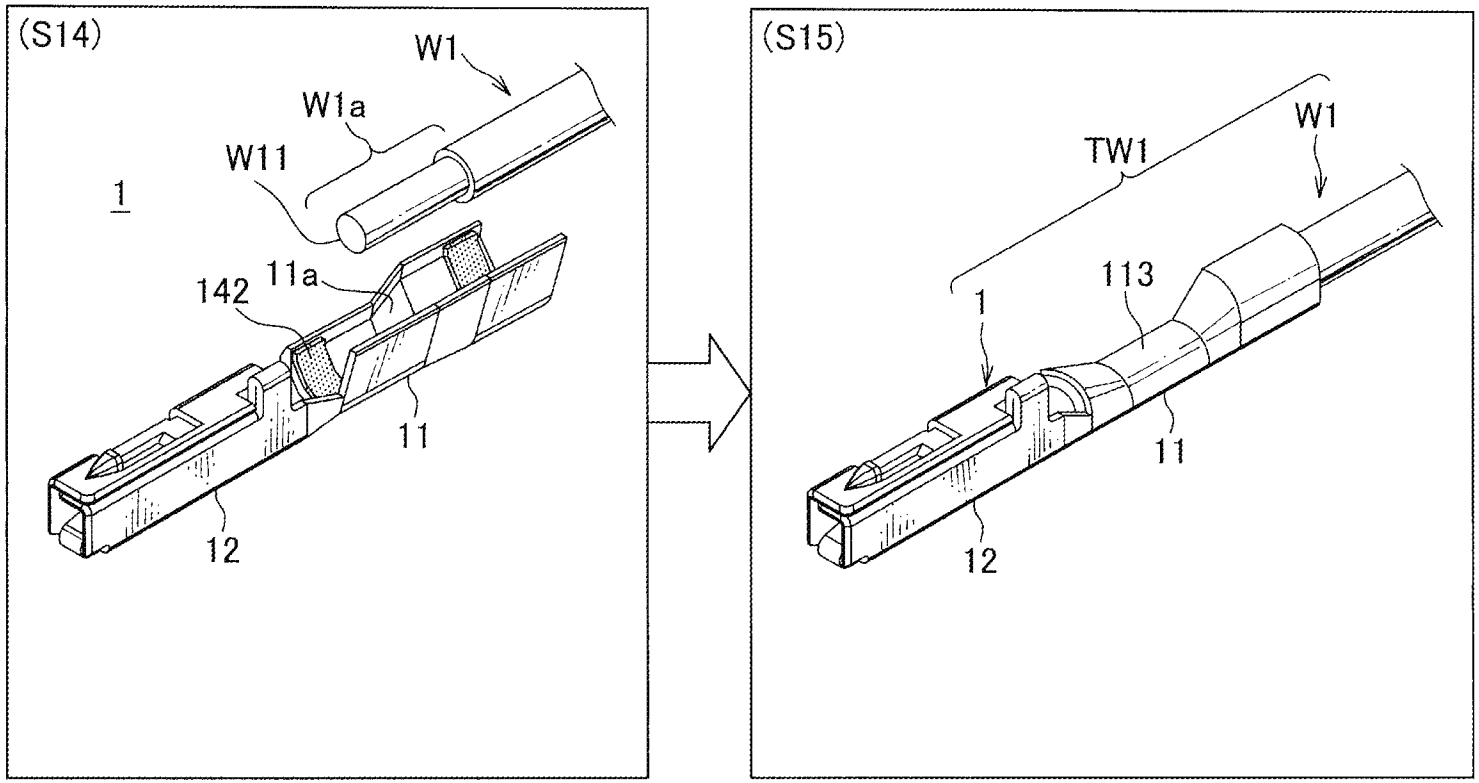
FIG. 4 is a view showing a procedure until the crimp terminal is crimped to the end portion of the covered electric wire following the procedure shown in FIG. 3.

FIG. 3 is a view showing a procedure until preparations are made by the terminal connecting method for crimping the crimp terminal shown in FIGS. 1 and 2 to an end portion of a covered electric wire, and FIG. 4 is a view showing a procedure until the crimp terminal is crimped to the end portion of the covered electric wire following the procedure shown in FIG. 3.

FIG. 3 shows the sheet metal working step (S11) and also shows the sealing member affixing step (S12) in the terminal manufacturing method described above. In the sheet metal working step (S11), the barrel section 11 and the terminal section 12 are formed, and in the sealing member affixing step (S12), the first seal portion 141, the second seal portion 142 and the third seal portion 143 constituting the seal member 14 are affixed.

When crimping the end portion W1*a* of the covered electric wire W1, firstly, the crimp terminal 1 to be crimped is separated from the connecting piece 1*a* shown in FIG. 1. Then, for the barrel section 11, bending deformation is performed as preparation for placing the end portion W1*a* of the covered electric wire W1 (S13). This bending deformation is performed such that the inner barrel piece 112 and the outer barrel piece 113 are brought close to each other so that the cross section intersecting with the axial direction D11 is substantially U-shaped.

Subsequently, the placing step of placing the end portion W1*a* of the covered electric wire W1 on the barrel section 11 after the bending deformation is performed as follows (S14).

Figure 5:
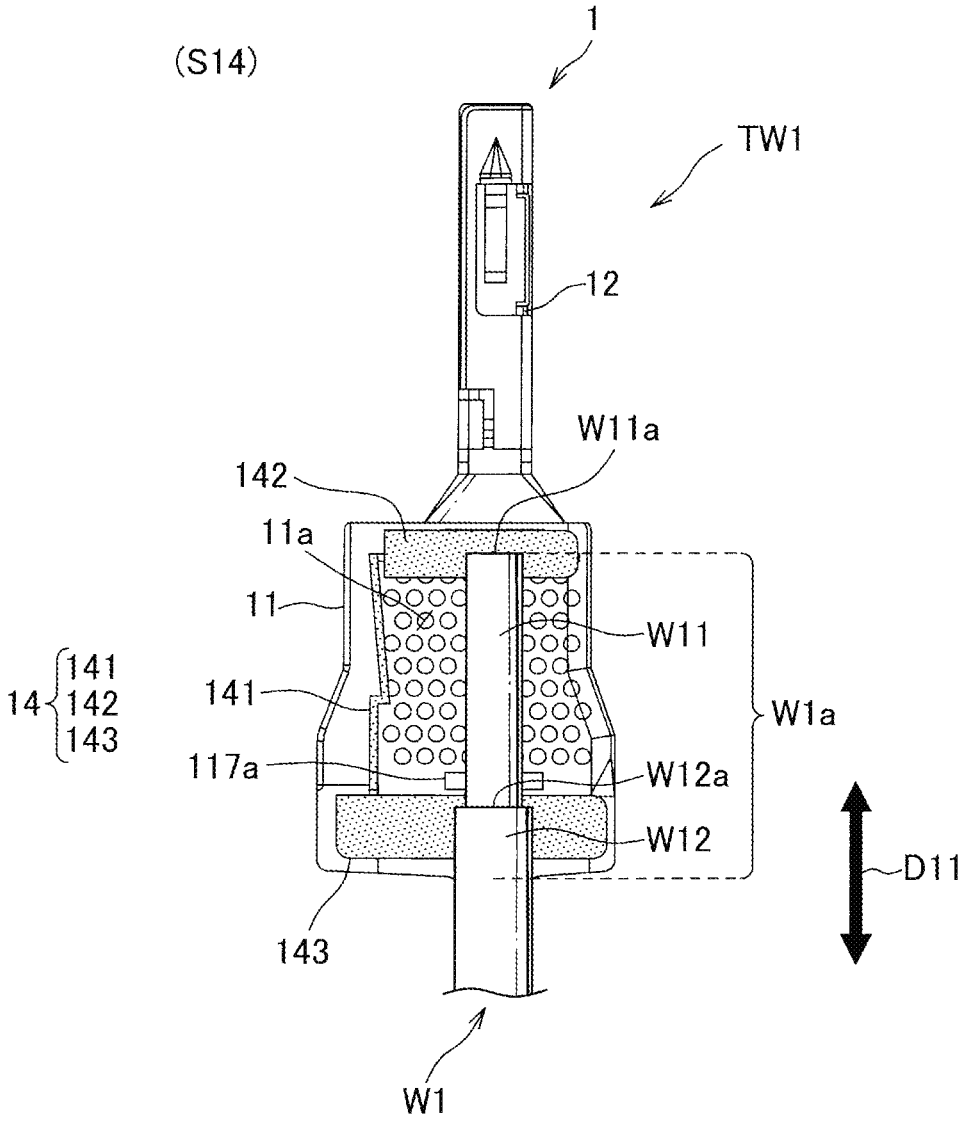
FIG. 5 is a view showing the placing step shown in FIG. 4 in plan view with respect to the inner surface of the barrel section.

FIG. 5 is a view showing the placing step shown in FIG. 4 in plan view with respect to the inner surface of the barrel section. Incidentally, in FIG. 5, in order to make the positional relationship between the end portion W1*a* of the covered electric wire W1 and each portion on the inner surface 11*a* of the barrel section 11 easier to see, the barrel section 11 shown in a curved shape in FIG. 4 is shown in a flatly extended state.

In the placing step (S14), the end portion W1*a* is placed on the inner surface 11*a* of the barrel section 11 along the axial direction D11 so that the end portion W11*a* of the aluminum core wire W11 at the end portion W1*a* overlaps with the second seal portion 142 of the sealing member 14. Further, in this placing step (S14), the end portion W1*a* is placed on the inner surface 11*a* of the barrel section 11 so that the tip end W12*a* of the covered portion W12 overlaps with the third seal portion 143 of the sealing member 14. Further, in this placing step (S14), the exposed portion of the aluminum core wire W11 is placed so as to be in contact with the first indent portion 117*a*.

Following the placing step (S14) described above, as shown in FIG. 4, the crimping step (S15) is performed in which the barrel section 11 is wound around the end portion W1*a* and crimped so that the outer barrel piece 113 is overlapped with the inner barrel part 112 facing inward. With this crimping step (S15), the wire TW1 with terminal in which the crimp terminal 1 is connected to the covered wire W1 is completed.

Here, in the crimping step (S15), the sealing member 14 seals each part of the crimp terminal 1 as follows, and the wire with terminal TW1 is formed.

Figure 6:
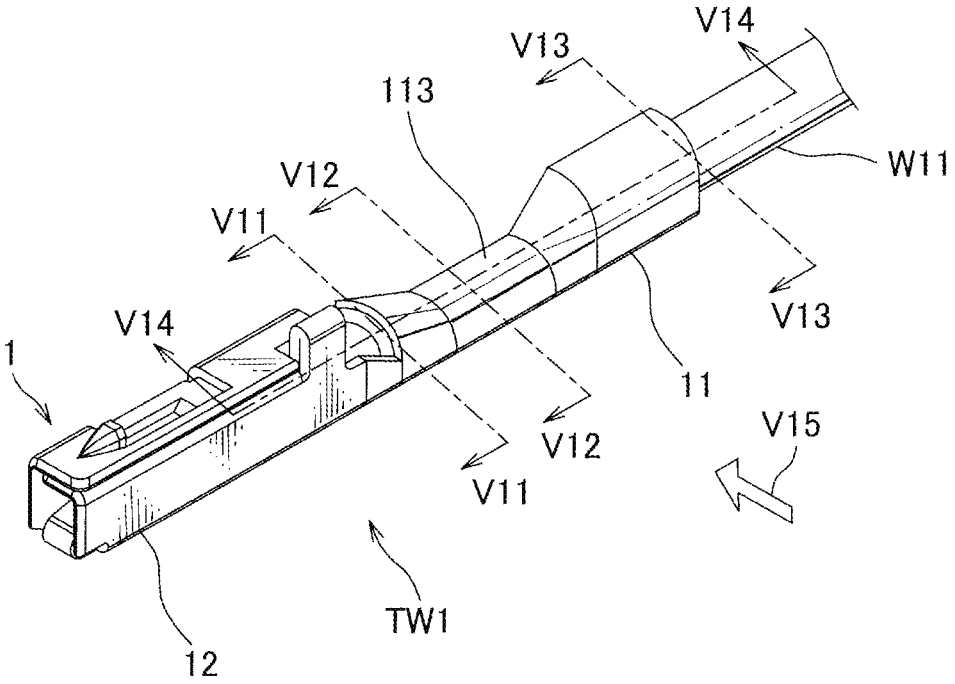
FIG. 6 is a view showing the wire with terminal after crimping also shown in FIG. 4.
Figure 7:
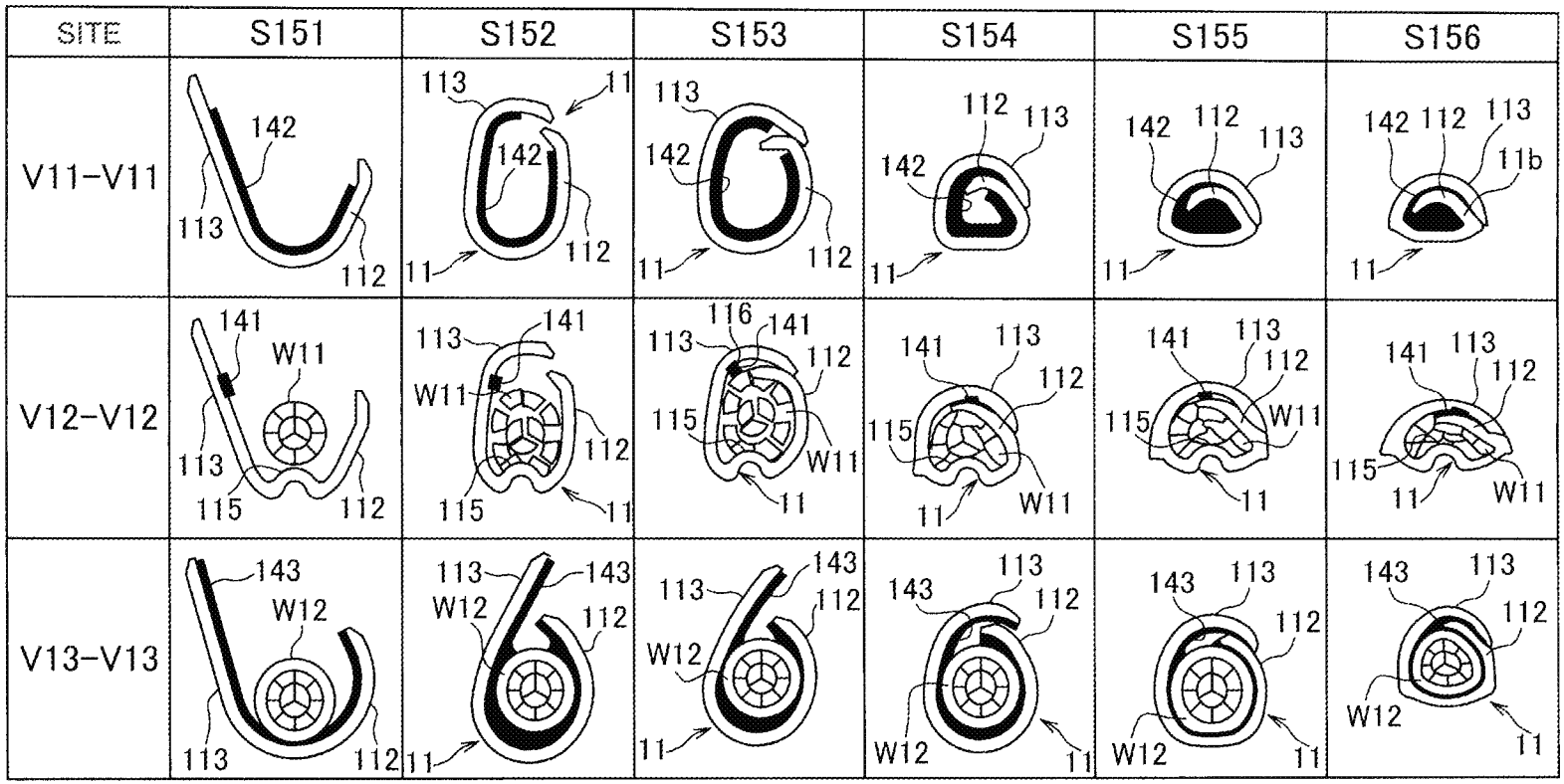
FIG. 7 is a view showing a change during a crimping step in a cross section taken along line V11-V11, a cross section taken along line V12-V12, and a cross section taken along line V13-V13 in FIG. 6.

FIG. 6 is a view showing the wire with terminal after crimping also shown in FIG. 4. FIG. 7 is a view showing a change during the crimping step in a cross section taken along line V11-V11, a cross section taken along line V12-V12, and a cross section taken along line V13-V13 in FIG. 6.

In the first step (S151) of the crimping step, bending of the inner barrel piece 112 and the outer barrel piece 113 is started so as to wind around the aluminum core wire W11 on the convex section 115 and the covered portion W12 in the vicinity thereof. At this time, the first seal portion 141 is in contact with the aluminum core wire W11, the third seal portion 143 is in contact with the covered portion W12, and almost none of the second seal portion 142 contacts. In the second step (S152) and the third step (S153) in which the winding is slightly advanced, the barrel section 11 has a tubular shape. Then, the first seal portion 141 is sandwiched between the inner barrel piece 112 and the outer barrel piece 113, and the third seal part 143 is extended in a state sandwiched between the covering portion W12 and the barrel section 11.

At this time, in the present embodiment, since the first seal portion 141 is formed to have a width and shape corresponding to the groove section 116, the amount of the sealing member 14 sandwiched between the inner barrel piece 112 and the outer barrel piece 113 is minimized. If the amount of the sealing member 14 at this portion is too large, there is a case that the outer barrel piece 113 may be difficult to move with respect to the inner barrel piece 112 at the time of winding and hindering crimping. In contrast, in the present embodiment, since the amount of the sealing member 14 at this portion is suppressed, such interference by the sealing member 14 at the time of crimping can be prevented.

In the fourth step (S154), the fifth step (S155), and the sixth step (S156) where pressure is applied to the aluminum core wire W11 etc., the edges of the plurality of concave sections 114 dig into the aluminum core wire W11. At this time, the strands of the aluminum core wire W11 are spread by the convex section 115 located under the aluminum core wire W11, and the number of contacts between the barrel section 11 and these strands increases. At the same time, the extension of the seal member 14 also proceeds.

Here, as described above, in the present embodiment, a slight gap G11 opens between the second seal portion 142 and the first seal portion 141, and a slight gap G12 opens between the third seal portion 143 and the first seal portion 141. Theses gaps G11, G12 are closed by extension of the seal member 14 during crimping.

Figure 8:
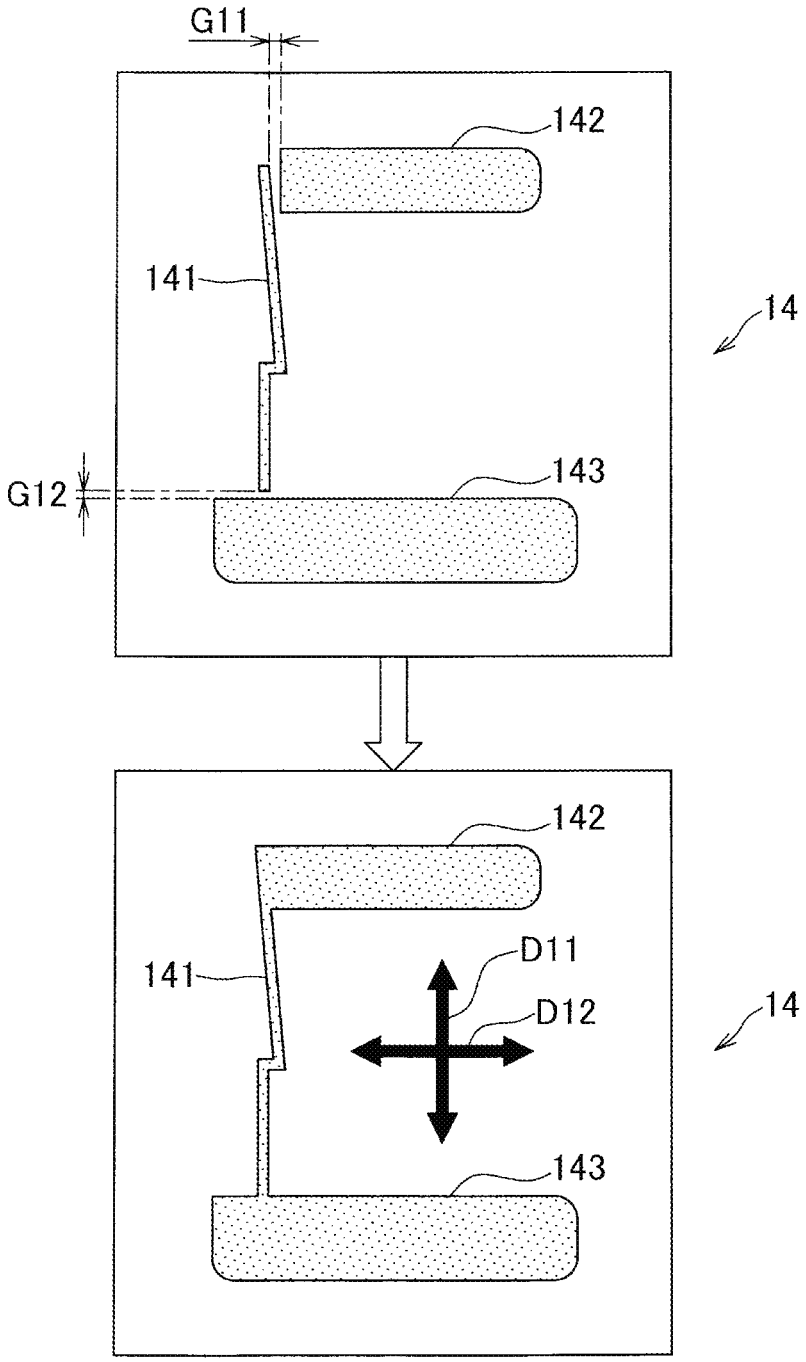
FIG. 8 is a schematic view showing how the gap between the second seal portion and the first seal portion, and between the third seal portion and the first seal portion shown in FIG. 2 is closed by extension of the seal member at the time of crimping.

FIG. 8 is a schematic view showing how the gap between the second seal portion and the first seal portion, and between the third seal portion and the first seal portion shown in FIG. 2 is closed by extension of the seal member at the time of crimping.

As shown in FIG. 8, at the time of crimping, the second seal portion 142 is extended in the crossing direction D12 which coincides with a length direction thereof. Due to this extension, the second seal portion 142 is connected to the first seal portion 141, and the gap G11 is closed. On the other hand, the first seal portion 141 is extended in the axial direction D11 coincident with the longitudinal direction thereof. Due to this extension, the first seal portion 141 is connected to the third seal portion 143, and the gap G12 therebetween is closed.

Next, in the sixth step (S156), a space between the inner barrel piece 112 and the outer barrel piece 113, the opening 11*b* of the tubular barrel section 11 on a side of the terminal section 12, and a space between the covered portion W12 and the barrel section 11 are sealed by the extended sealing member 14.

Figure 9:
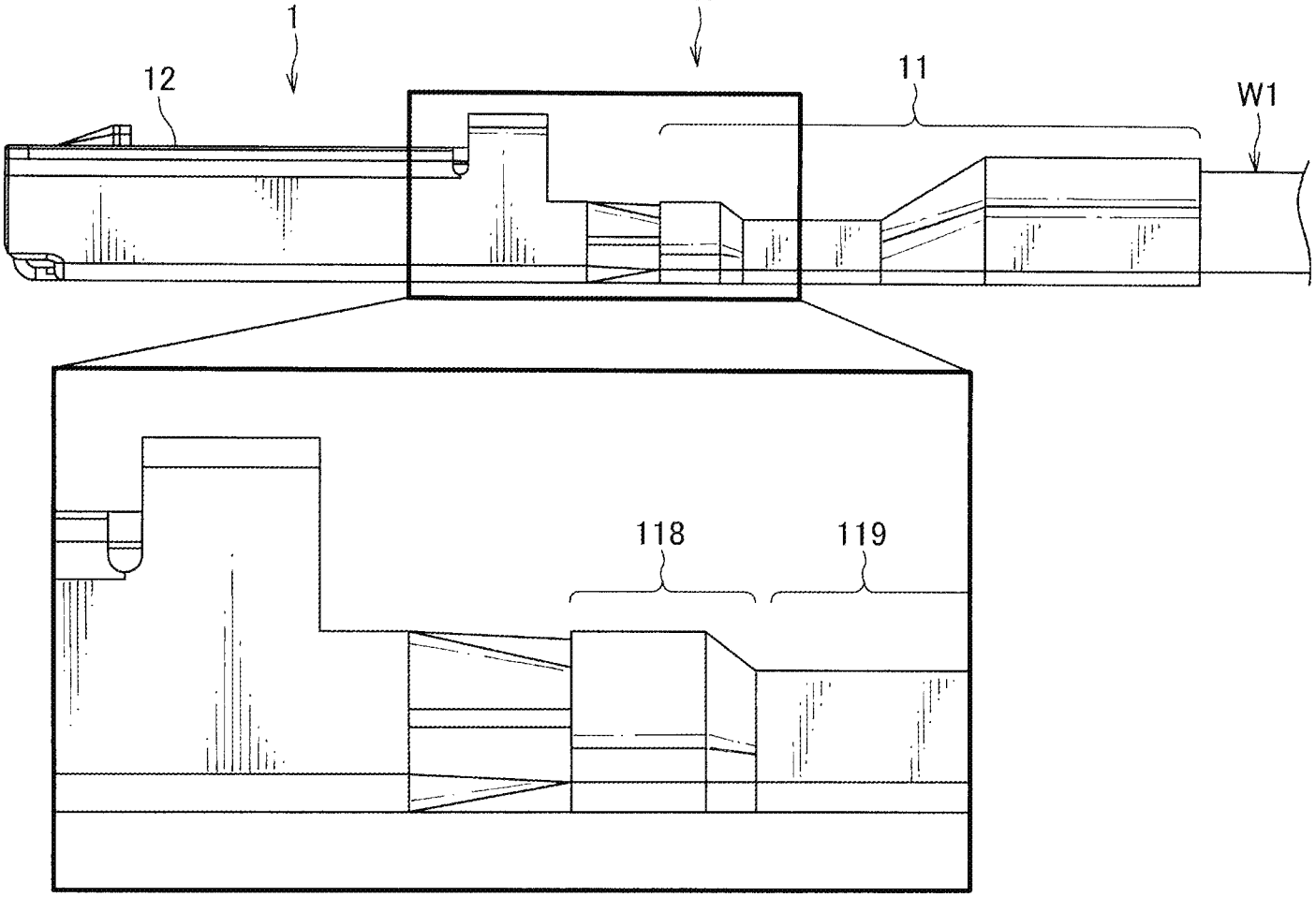
FIG. 9 is a side view showing the wire with terminal in FIG. 6, as viewed in a direction of an arrow V15.
Figure 10:
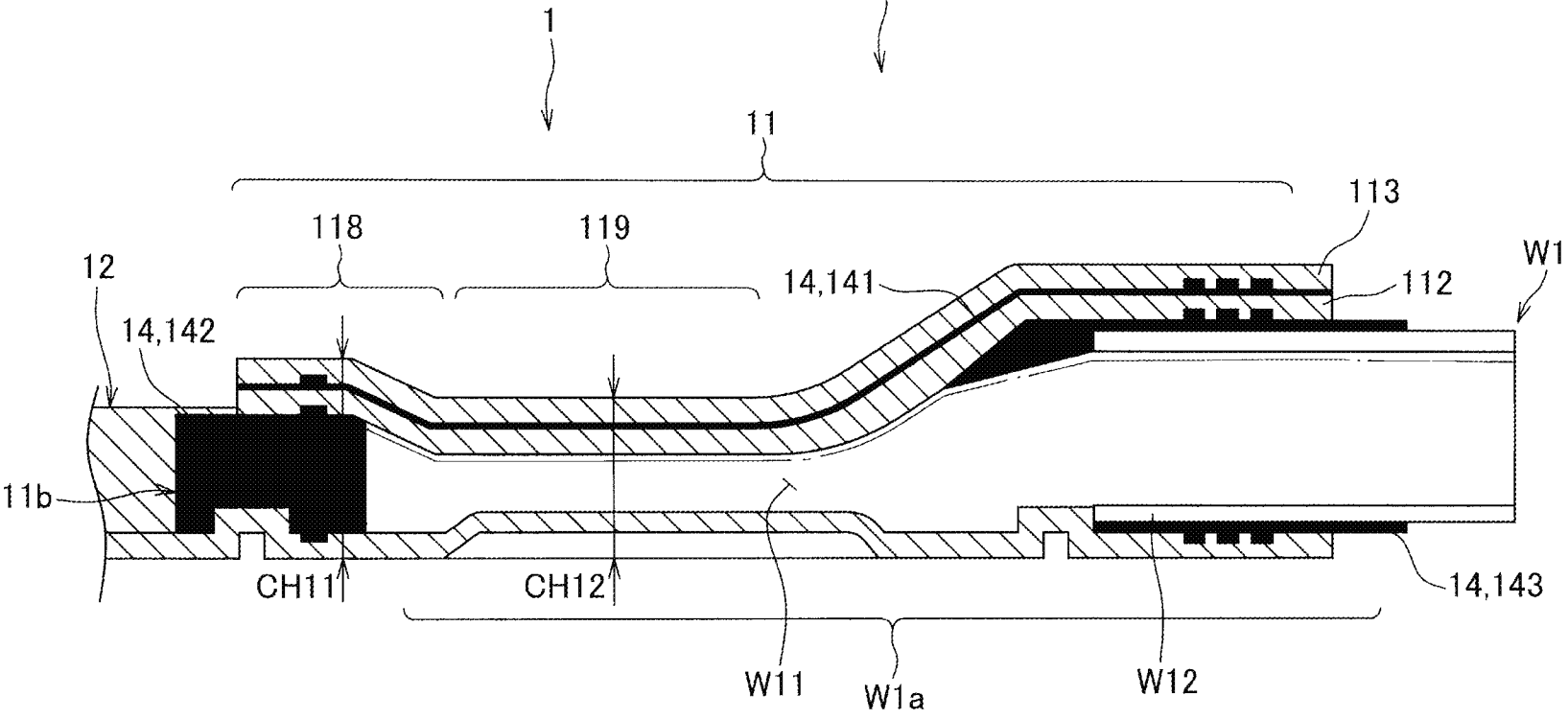
FIG. 10 is a sectional view taken along line V14-V14 in FIG. 6.

FIG. 9 is a side view showing the wire with terminal in FIG. 6, as viewed in a direction of an arrow V15, and FIG. 10 is a sectional view taken along line V14-V14 in FIG. 6.

As shown in FIG. 10, the space between the inner barrel piece 112 and the outer barrel piece 113 is sealed by the first seal portion 141, and the opening 11*b* of the barrel section 11 on the side of the terminal section 12 is sealed by the second seal portion 142. Further, a space between the covered portion W12 and the barrel section 11 is sealed by the third seal portion 143.

Here, in the present embodiment, a dimension of the barrel section 11 after the crimping (hereinafter referred to as the crimp height CH11) at a side of the terminal portion 12 (hereinafter referred to as the front end portion 118) in the vertical direction in FIG. 10 is set to the following dimension. That is, the crimp height CH11 of the front end portion 118 is crimped so as to be larger than the crimp height CH12 of the crimp portion 119 of the aluminum core wire W11.

At this time, as described above, the second seal portion 142 of the seal member 14 located on the side of the terminal portion 12 is formed in a band shape with a width that is partly extruded from the opening 11*b* of the barrel section 11 after crimping. As a result, as shown in FIG. 10, a part of the seal member 14 protrudes from the opening 11*b* of the front end portion 118 formed by the crimp height CH11 as described above. In other words, the crimp height CH11 of the front end portion 118 is set to such a size that the cylindrical barrel section 11 is crushed to such an extent that the sealing member 14 protrudes.

By the protrusion of the seal member 14 from the opening 11*b*, the opening 11*b* of the barrel section 11 is sealed at a high level. Further, a part of the seal member 14 also protrudes from between the covered portion W12 and the barrel section 11 on the extending side of the covered electric wire W1 in the barrel section 11 to seal this portion at a high level. On the other hand, the space between the inner barrel piece 112 and the outer barrel piece 113 is sealed by the minimum amount of the first seal portion 141 formed in a width and shape corresponding to the groove section 116. As a result, the barrel section 11 is hermetically sealed at various places while suppressing the hindrance of the crimping by the seal member 14.

Further, by forming each portion of the seal member 14 so as to protrude from the opening 11*b* of the barrel section 11 or from the extending side of the covered electric wire W1, it is possible to visually check that these portions are surely sealed with the seal member 14 after crimping. Then, by relatively reducing the crimp height CH12 of the crimping portion 112 as described above, the crimping of the aluminum core wire W11 is strengthened, and the contact reliability with the crimp terminal 1 is improved.

In the embodiment described above, the edges of the respective concave sections 114 provided on the inner surface 11*a* of the barrel section 11 by crimping bites into the aluminum core wire W11, whereby good conduction between the covered electric wire W1 and the crimp terminal 1 can be obtained. Then, the seal member 14 is affixed to the inner surface 11*a* of the barrel section 11 to seal between the inner barrel piece 112 and the outer barrel piece 113, the opening 11*b* of the cylindrical barrel section 11 on the terminal section 12 side, and the space between the covered part W12 and the barrel section 11 after crimping. Here, in the present embodiment, the second seal portion 142 affixed to the second region 11*a*-2 of the seal member 14 is formed in a belt shape with a width that is partly extruded from the opening 11*b* after crimping. On the other hand, the first seal portion 141 affixed to the first region 11*a*-1 is formed in a width and shape corresponding to the groove section 116. The waterproof property against the contact portion with the aluminum core wire W11 is obtained over the entire periphery thereof by the seal member 14. Particularly, the waterproofness of the opening 11*b* close to the aluminum core wire W11 is enhanced by the second seal portion 142 formed in a belt shape with a width that is partly extruded from the opening 11*b* after crimping. Then, the first seal portion 141 is formed in a width and shape corresponding to the groove section 116 of the first region 11*a*-1, so that the amount is minimized and hindrance caused by the seal member 14 is suppressed when winding the inner barrel piece 112 inside and crimped. As described above, according to the present embodiment, difficulty in manufacturing can be alleviated while ensuring waterproofness against the contact portion with the aluminum core wire W11.

Here, in the present embodiment, the groove section 116 is also provided in the third region 11*a*-3 so as to extend in the crossing direction D12. Since the groove section 116 provided in the third region 11*a*-3 plays a role of suppressing the displacement of the third seal portion 143 at the time of crimping, it is possible to further alleviate difficulties in manufacturing. Similarly, the groove section 116 is also provided in the second region 11*a*-2 so as to extend in the crossing direction D11. Since the groove section 116 of the second region 11*a*-1 plays a role of suppressing positional displacement of the second seal portion 142 at the time of crimping, in the present embodiment, in all the affixing portions of the seal member 14, the positional deviation at the time of crimping is suppressed and the manufacturing difficulty is further alleviated.

Further, in the present embodiment, the groove section 116 is provided so as to extend in three rows in the axial direction D11 in the third region 11*a*-3. As a result, since the groove section 116 is provided in three rows in the third region 11*a*-3 which intersects with the covered portion W12 which is easy to move during crimping or the like, the positional displacement of the third seal portion 143 affixed to the third region 11*a*-3 is further suppressed. This makes it possible to further alleviate manufacturing difficulties.

In the terminal connecting method of this embodiment described with reference to FIGS. 3 to 4, in the above-described placing step (S14), the end portion W1*a* of the covered electric wire W1 is formed on the inner surface 11*a* of the barrel section 11 as follows. That is, the end portion W1*a* of the covered electric wire W1 is placed such that the tip W11*a* of the aluminum core wire W11 overlaps with the second seal portion 142 of the seal member 14 close to the terminal section 12. Thereby, a portion even slightly deviated from the second seal portion 142 in the axial direction D11 can immediately contribute to electrical conduction with the aluminum core wire W11. As a result, the electrical conductivity between the aluminum core wire W11 and the crimp terminal 1 is sufficiently secured. As described above, according to the terminal connecting method of the present embodiment, it is possible to ensure sufficient electrical conductivity between the exposed aluminum core W11 and the crimp terminal 1 while securing waterproofness against a contact portion with the aluminum core wire W11.

Here, in the present embodiment, the placing step (S14) includes the step of placing the end W1*a* on the inner surface 11*a* of the barrel section 11 so that the tip end W12*a* of the covered portion W12 overlaps with the third seal portion 143. As a result, the portion between the second seal portion 142 and the third seal portion 143 in the axial direction D11 contributes to electrical conduction with the aluminum core wire W11 over substantially the entire length. Thereby, the conductivity between the exposed aluminum core wire W11 and the crimp terminal 1 can be further improved.

Further, as shown in FIG. 2, in the electric wire with terminal TW1 of the present embodiment, the first indent portion 117*a* is provided at the position not overlapping with the seal member 14 and closer to the third region 11*a*-3. Then, as shown in FIG. 5, the barrel portion 11 is crimped to the end portion W1*a* of the covered electric wire W1 so that the aluminum core wire W11 is in contact with the first indent portion 117*a*.

The first indent portion 117 a extending in the crossing direction D12 plays a role of resisting the return of the barrel section 11 after crimping. At this time, when the seal member 14 made of a flexible adhesive gel overlaps with the first indent portion 117*a* and is wound around the end portion W1*a*, there is a case where the seal member 14 may behave as follows. That is, there is a case that a portion overlapping with the first indent portion 117*a* may serve as a cushion at the time of crimping to widen the winding diameter at the first indent portion 117*a* to weaken the role of the first indent portion 117*a*.

However, in the present embodiment, the first indent portion 117*a* is directly contacted with the aluminum core wire W11 without interposing the sealing member 14. Accordingly, the first indent portion 117*a* can resist the return of the barrel section 11 without being affected by the seal member 14. Further, since the first indent portion 117*a* is wound without interposing the coating of the covered electric wire W1 therebetween, the wound diameter is also suppressed with respect to the thickness of the covering. Even in this point as well, the return of the barrel section 11 can be satisfactorily resisted. As a result, the return of the barrel section 11 is favorably suppressed. As described above, according to the present embodiment, it is possible to suppress the return of the barrel section 11 while ensuring the waterproof property against the contact portion with the aluminum core wire W11. In addition, since the first indent portion 117*a* directly contacts the aluminum core wire W11, the conductivity between the crimp terminal 1 and the aluminum core wire W11 can also be sufficiently secured.

Here, in the present embodiment, as shown in FIG. 2, a second indent portion 117*b* extending in the crossing direction D12 is also provided on the inner surface 11*a* of the barrel section 11 at a position close to the terminal portion 12. As a result, the return of the barrel section 11 can be satisfactorily suppressed by both of the vicinity of the terminal portion 12 of the barrel section 11 and the opposite side thereof.

Further, in the present embodiment, the first indent portion 117*a* and the second indent portion 117*b* obtained by sheet metal working are employed as the ridge portion of the inner surface 11*a* of the barrel portion 11. Generally, since the resistance of the indent portion against the return as described above is strong, the return of the barrel section 11 can be more satisfactorily suppressed.

Further, in the present embodiment, as shown in FIG. 5, the barrel section 11 is crimped at the end portion W1*a* of the covered electric wire W1 so that the tip end W12*a* of the covered portion W12 at the end portion W1*a* overlaps with the third seal portion 143. In view of this, in the present embodiment, the first indent portion 117*a* is provided as close as possible to the third region 11*a*-3. According to the present embodiment, by bringing the aluminum core wire W11 into contact with the first indent portion 117*a* at such a position, return can be more effectively suppressed at a position close to the end edge of the barrel section 11.

Further, in the terminal connecting method of the present embodiment described with reference to FIGS. 3 to 4, in the placing step (S14), the end portion W1*a* is placed on the inner surface 11*a* of the barrel section 11 so that the aluminum core wire W11 is in contact with the first indent portion 117*a*. As a result, as described above, the return of the barrel portion 11 can be favorably suppressed without the first indent portion 117*a* being affected by the seal member 14. As described above, according to the terminal connecting method of the present embodiment, it is possible to suppress the return of the barrel section 11 while ensuring the waterproof property against the contact portion with the aluminum core wire W11.

Further, in the terminal connecting method of the present embodiment, the placing step (S14) is a step of placing the end portion W1*a* on the inner surface 11*a* of the barrel section 11 so that the tip end W12*a* of the covered portion W12 overlaps with the third seal portion 143. Thus, as described above, it is possible to more effectively suppress the return at a position close to the end edge of the barrel section 11.

Further, in the terminal connecting method of the present embodiment, the placing step (S14) is a step of placing the end portion W1*a* on the inner surface 11*a* of the barrel section 11 so that the tip end W11*a* of the aluminum core wire W11 overlaps with the second seal portion 142. As also described above, the conductivity between the aluminum core wire W11 and the crimp terminal 1 can be sufficiently secured.

Next, various modified examples of the above-described embodiment will be described.

Figure 11:
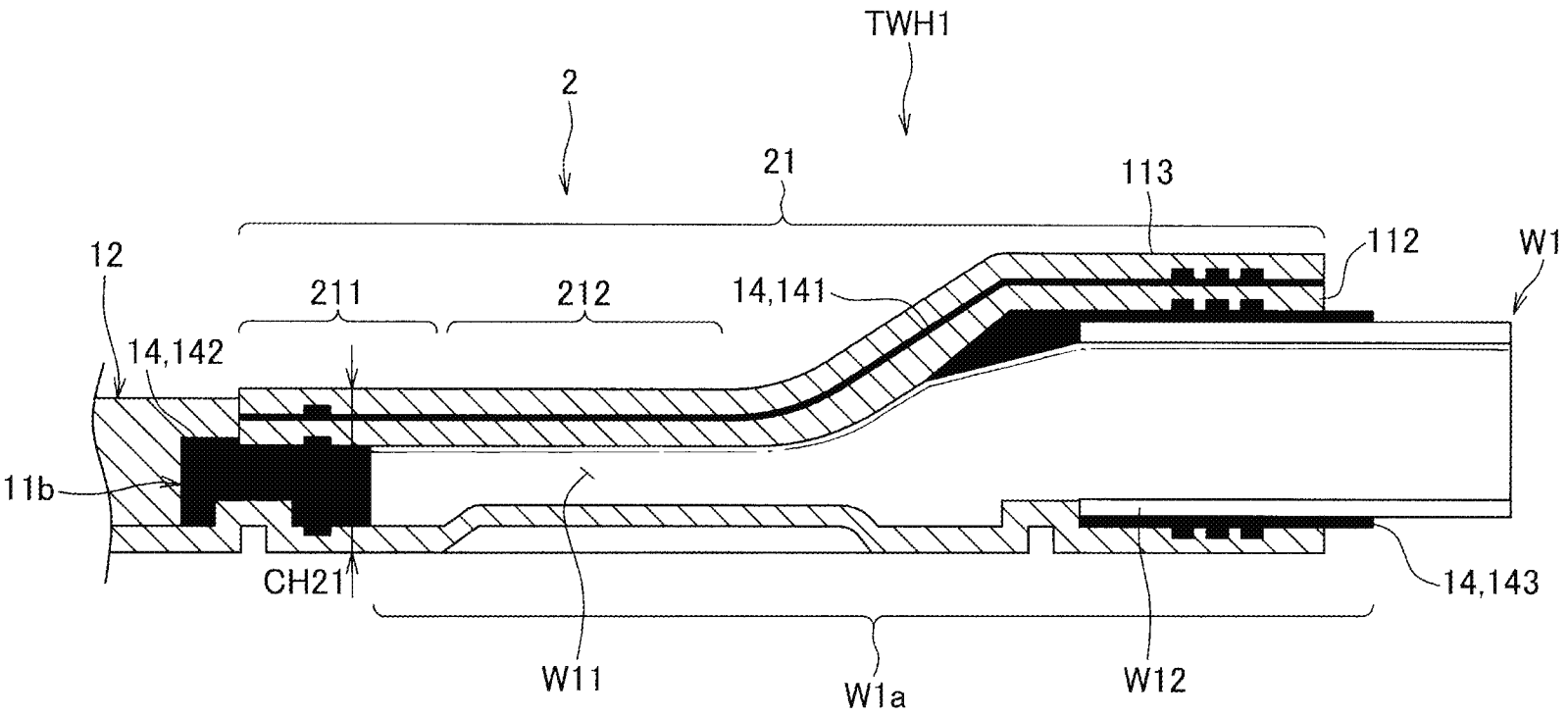
FIG. 11 is a view showing a first modification of the embodiment shown in FIGS. 1 to 10.

FIG. 11 is a view showing a first modification of the embodiment shown in FIGS. 1 to 10. Incidentally, in FIG. 11, the same reference numerals are given to the same constituent elements as those shown in FIGS. 1 to 10, and in the following, redundant description of these equivalent elements will be omitted. This also applies to drawings to be referred to in other modified examples to be described later and to descriptions of modifications thereof.

In the wire with terminal TWH 1 of the first modified example, the crimp terminal 2 is crimped so that the crimp height CH 21 of the same degree can be obtained by the front end portion 211 of the barrel section 21 and the crimp portion 212 of the aluminum core wire W11 after crimping. Then, the second seal portion 142 of the sheet member 14 is formed into a band shape with a width that is partially extruded from the opening 11*b* by the crimp height CH21 at this time. Also in this first modification, while preventing interference of the crimping by the seal member 14 with the minimum amount of the first seal portion 141, for the opening 11*b* requiring a relatively large amount for sealing, sealing is performed by the second seal portion 142 having the width as described above.

Figure 12:
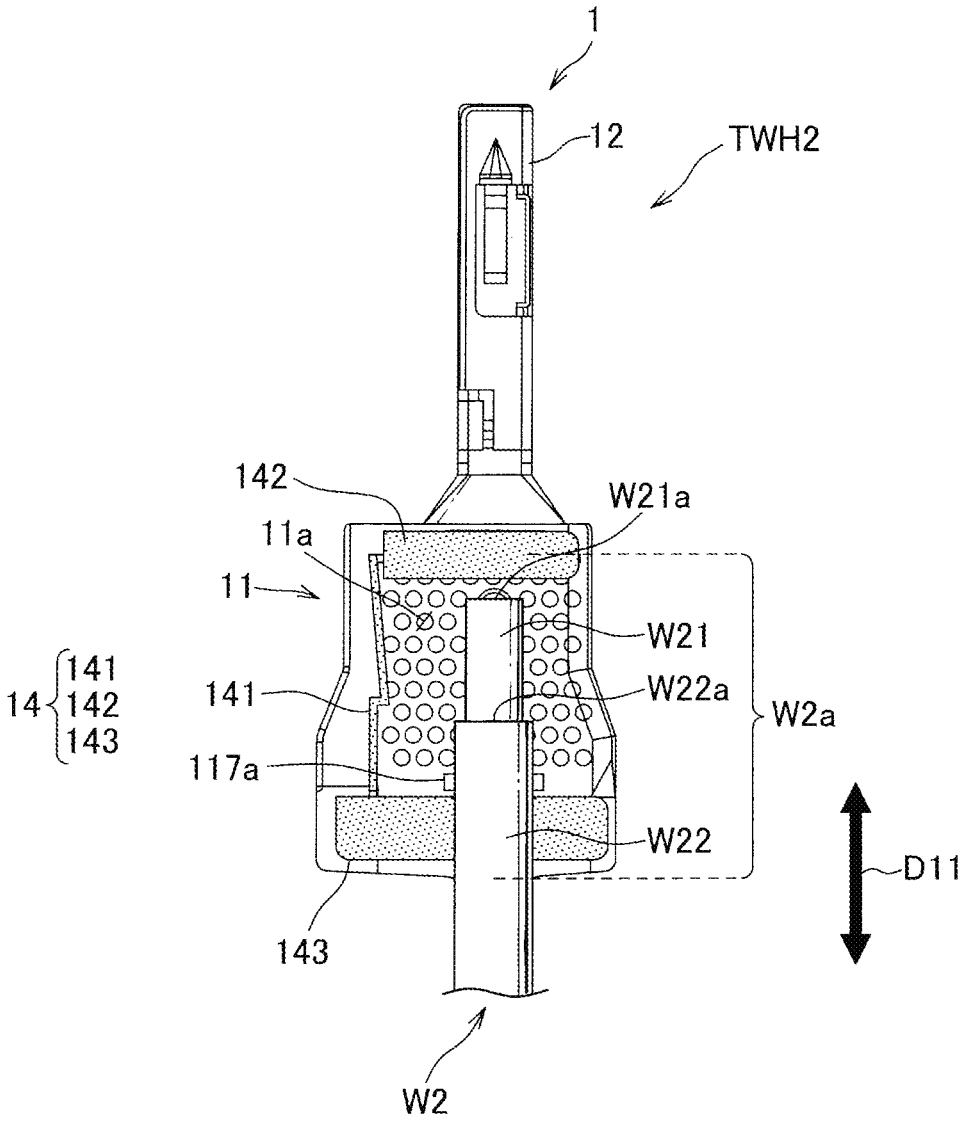
FIG. 12 is a view showing a second modification of the embodiment shown in FIGS. 1 to 10.

FIG. 12 is a view showing a second modification of the embodiment shown in FIGS. 1 to 10.

The wire with terminal TWH2 of the second modification differs from the above-described embodiment in the state of placement of the end portion W2*a* of the covered electric wire W2 on the inner surface 11*a* of the barrel section 11. That is, in the second modification, the end W2*a* of the covered electric wire W2 is provided on the inner surface 11*a* of the barrel section 11 so that the tip end W21*a* of the aluminum core wire W21 is detached from the second seal portion 142 on the side opposite to the terminal portion 12. Furthermore, in this second modification, the end portion W2*a* of the covered electric wire W2 is placed on the inner face 11*a* of the barrel section 11 so that the tip end W22*a* of the covered portion W22 is detached from the third seal portion 143 toward the terminal portion 12. As a result, in the second modification, the crimp terminal 1 is crimped onto the covered wire W2 so that the covered portion W22 is in contact with the first indent portion 117*a*.

Compared with the second modification, the above-described embodiment makes it possible to contribute to electrical conduction over a longer range on the inner surface 11*a* of the barrel section 11 in the axial direction D11, and ensures sufficient conductivity as described above. Further, in the above-described embodiment, since the first indent portion 117*a* is wound directly in contact with the aluminum core wire W11, the winding diameter is suppressed by the thickness of the covered portion and the return of the barrel section 11 can be favorably suppressed as described above.

On the other hand, also in this second modification, the second seal portion 142 is formed like a band with a width that is partly extruded from the opening 11*b* of the barrel section 11 after crimping, and the first seal portion 141 has a width corresponding to the groove section 116 in the same manner as the above-described embodiment. Therefore, it is needless to say that it is possible to alleviate the difficulty in manufacturing, while ensuring the waterproof property against the contact portion with the aluminum core wire W21, also in this second modification similar to the above embodiment.

Figure 13:
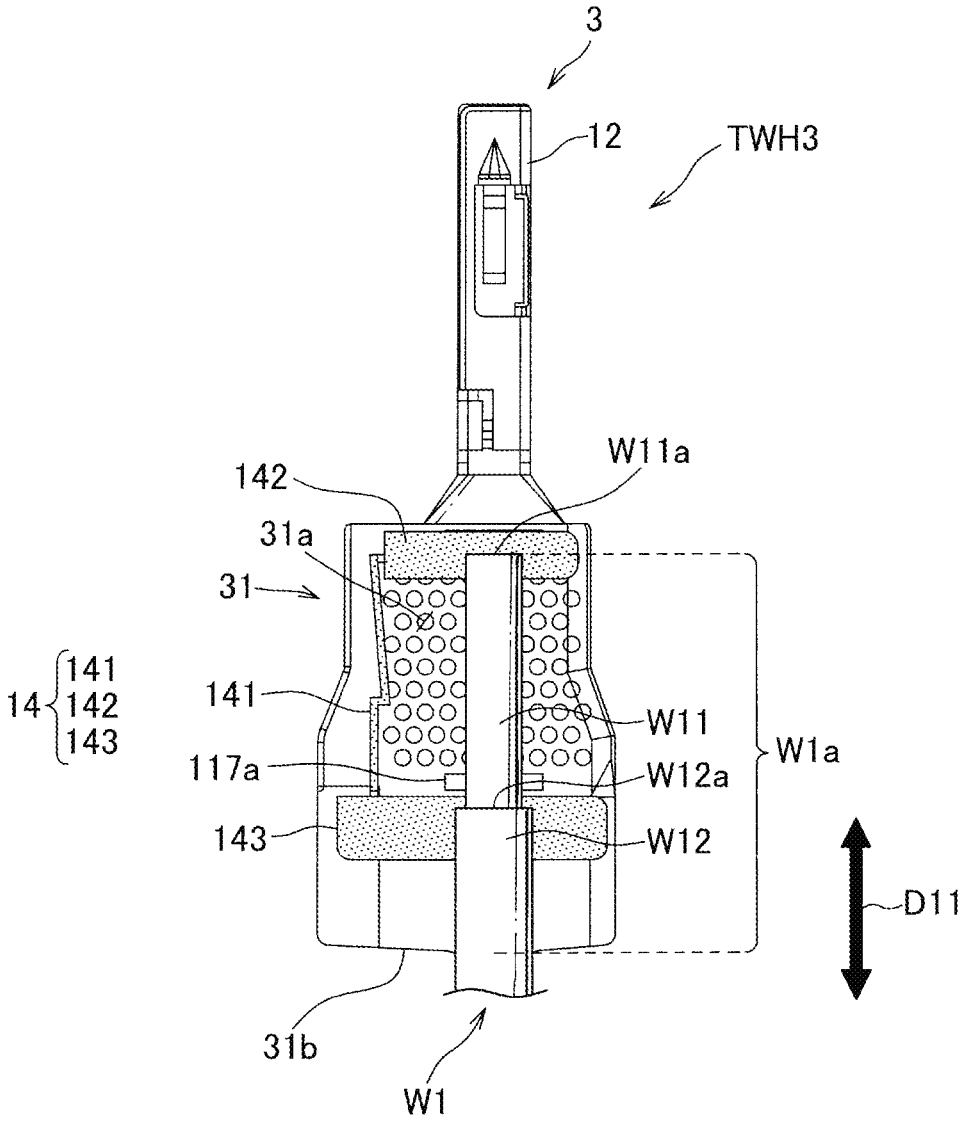
FIG. 13 is a view showing a third modification of the embodiment shown in FIGS. 1 to 10.

FIG. 13 is a view showing a third modification of the embodiment shown in FIGS. 1 to 10.

In the wire with terminal TWH 3 of the third modification, in the crimp terminal 3, the third seal portion 143 of the seal member 14 is disposed away from the end edge 31*b* of the barrel section 31 intersecting the covered portion W12. Therefore, in the terminal connection method of the third modification, the placing step of placing the end portion W1*a* of the covered portion W12 on the inner surface 31*a* of the barrel section 31 is the following process. That is, in the placing step in the third modification, the end portion W1*a* is placed so that the covered portion W12 directly contacts the inner surface 31*a* of the barrel section 31 in between the seal member 14 and the end edge 31*b* of the barrel section 31.

On the other hand, similarly to the above-described embodiment, the tip end W11*a* of the aluminum core wire W11 overlaps with the second seal portion 142, the tip end W12*a* of the covered portion W12 overlaps with the third seal portion 143, and the exposed portion of the aluminum core wire W11 contacts the first indent portion 117*a*. Further, also similarly to the above-described embodiment, the second seal portion 142 is formed like a band with a width such that a portion of the second seal portion 142 is extruded from the opening 11*b* of the barrel section 11 after crimping, and the first seal portion 141 is formed to have a width and shape corresponding to the groove section 116.

According to this third modification, it is needless to say that difficulty in manufacturing can be alleviated while securing waterproofness against the contact portion with the aluminum core wire W11 similar to the above-described embodiment. In addition, the point that the conductivity can be sufficiently secured and the point that the return of the barrel portion 31 can be suppressed well are also similar to the above-described embodiment.

Furthermore, according to the third modification, the portion between the third seal portion 143 of the seal member 14 and the end edge 31*b* of the barrel section 31 is in direct contact with the covered portion W12 and crimped. This makes it possible to improve the fixing force of the barrel section 31 to the covered portion W12 that is easy to move, for example, at the time of use and which is easily subjected to a force.

Next, three modifications to the groove section 116 in the barrel section 11 will be described as fourth to sixth modifications to the above-described embodiment.

Figure 14:
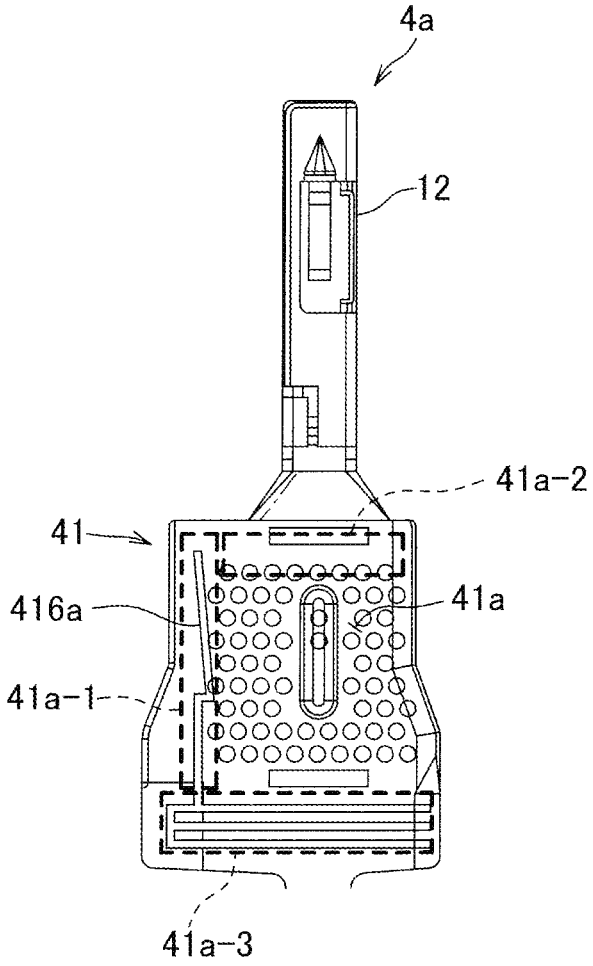
FIG. 14 is a view showing a fourth modification of the embodiment shown in FIGS. 1 to 10.

FIG. 14 is a view showing a fourth modification of the embodiment shown in FIGS. 1 to 10, FIG. 15 is a view showing a fifth modification of the embodiment shown in FIGS. 1 to 10, and FIG. 16 is a view showing a sixth modification of the embodiment shown in FIGS. 1 to 10. Incidentally, in these FIGS. 14 to 16, the crimp terminal in a state where the seal member is removed is shown so that the groove section in each modification can be seen.

In the crimp terminal 4*a* of the fourth modification shown in FIG. 14, the groove section 416*a* of the barrel section 41 is provided in the first region 41*a*-1 and the third region 41*a*-3 on the inner surface 41*a*, and not provided in the second region 41*a*-2. The shape of the groove section 416*a* in the first region 41*a*-1 and the third region 41*a*-3 is the same as the groove section 116 in the above-described embodiment.

Figure 15:
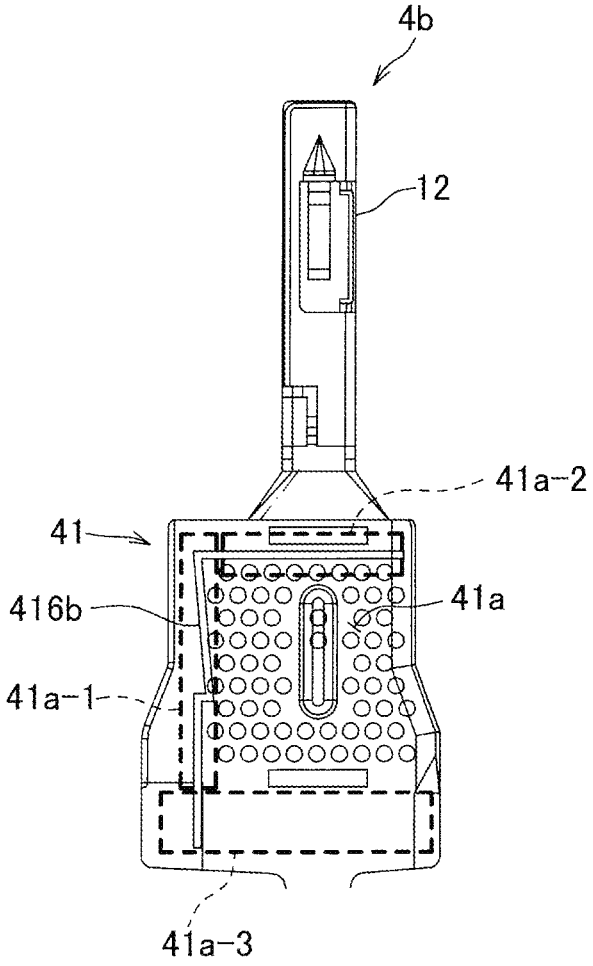
FIG. 15 is a view showing a fifth modification of the embodiment shown in FIGS. 1 to 10.

In the crimp terminal 4*b* of the fifth modification shown in FIG. 15, the groove section 416*b* of the barrel section 41 is provided in the first region 41*a*-1 and the second region 41*a*-2 on the inner surface 41*a*, and is not provided in the third region 41*a*-3 other than the extension from the first region 41*a*-1. The shape of the groove section 416*b* in the first region 41*a*-1 and the second region 41*a*-2 is the same as the groove section 116 in the above-described embodiment.

Figure 16:
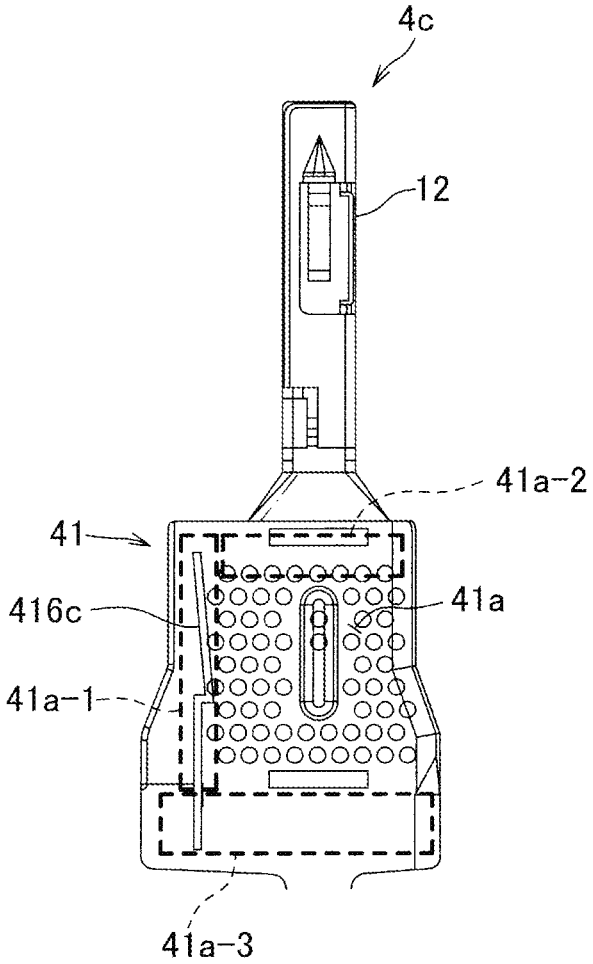
FIG. 16 is a view showing a sixth modification of the embodiment shown in FIGS. 1 to 10.

In the crimp terminal 4*c* of the sixth modification shown in FIG. 16, the groove section 416*c* of the barrel section 41 is provided in the first region 41*a*-1 on the inner surface 41*a* and is not provided in the second region 41*a*-2. Furthermore, the groove section 416*c* is not provided in the third region 41*a*-3 other than the extension from the first region 41*a*-1. The shape of the groove section 416*c* in the first region 41*a*-1 is the same as the groove section 116 in the above-described embodiment.

In any of these fourth to sixth modifications, as in the above-described embodiment, the seal member 14 is affixed and crimped to the end portion W1*a* of the covered electric wire W1. As a result, it is needless to say that difficulty in manufacturing can be alleviated while securing waterproofness against the contact portion with the aluminum core wire W11 similar to this embodiment. In addition, the point that the conductivity can be sufficiently secured and the point that the return of the barrel sections 41, 51, 61 can be satisfactorily suppressed are also similar to the above-described embodiment.

Next, five modifications to the seal member 14 will be described as seventh to eleventh modifications to the above-described embodiment.

Figure 17:
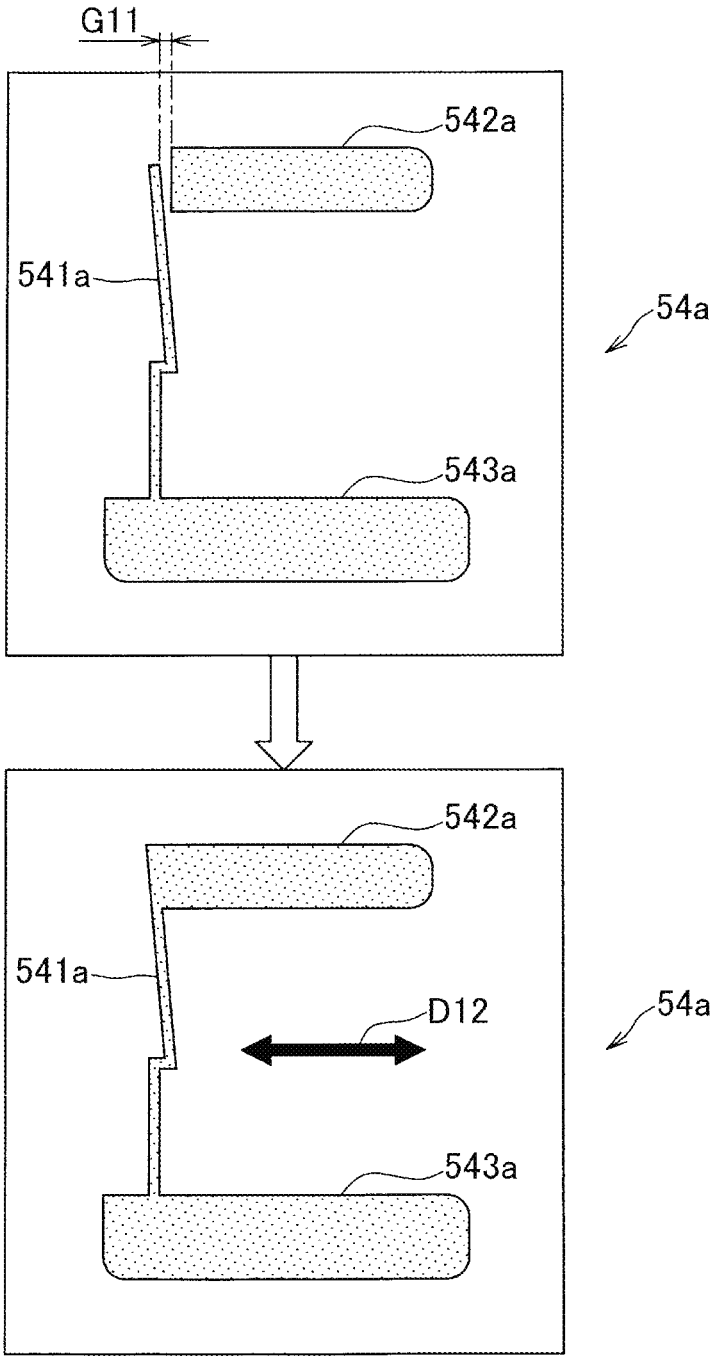
FIG. 17 is a view showing a seventh modification of the embodiment shown in FIGS. 1 to 10.

FIG. 17 is a view showing a seventh modification of the embodiment shown in FIGS. 1 to 10, FIG. 18 is a view showing an eighth modification of the embodiment shown in FIGS. 1 to 10, FIG. 19 is a view showing a ninth modification of the embodiment shown in FIGS. 1 to 10, FIG. 20 is a view showing a tenth modification of the embodiment shown in FIGS. 1 to 10, and FIG. 21 is a view showing a eleventh modification of the embodiment shown in FIGS. 1 to 10.

In the seal member 54*a* of the seventh modification shown in FIG. 17, the second seal portion 542*a* is divided from the first seal portion 541*a*, but the third seal portion 543*a* is connected to the first seal portion 541*a*. The shape of each seal portion is substantially the same as each seal portion of the seal member 14 in the above-described embodiment. In the seal member 54*a* according to the seventh modification, the second seal portion 542*a* is extended in the crossing direction D12 that coincides with the length direction thereof during crimping. Due to this extension, the second seal portion 542*a* is connected to the first seal portion 541*a*, and a gap G11 therebetween is blocked.

Figure 18:
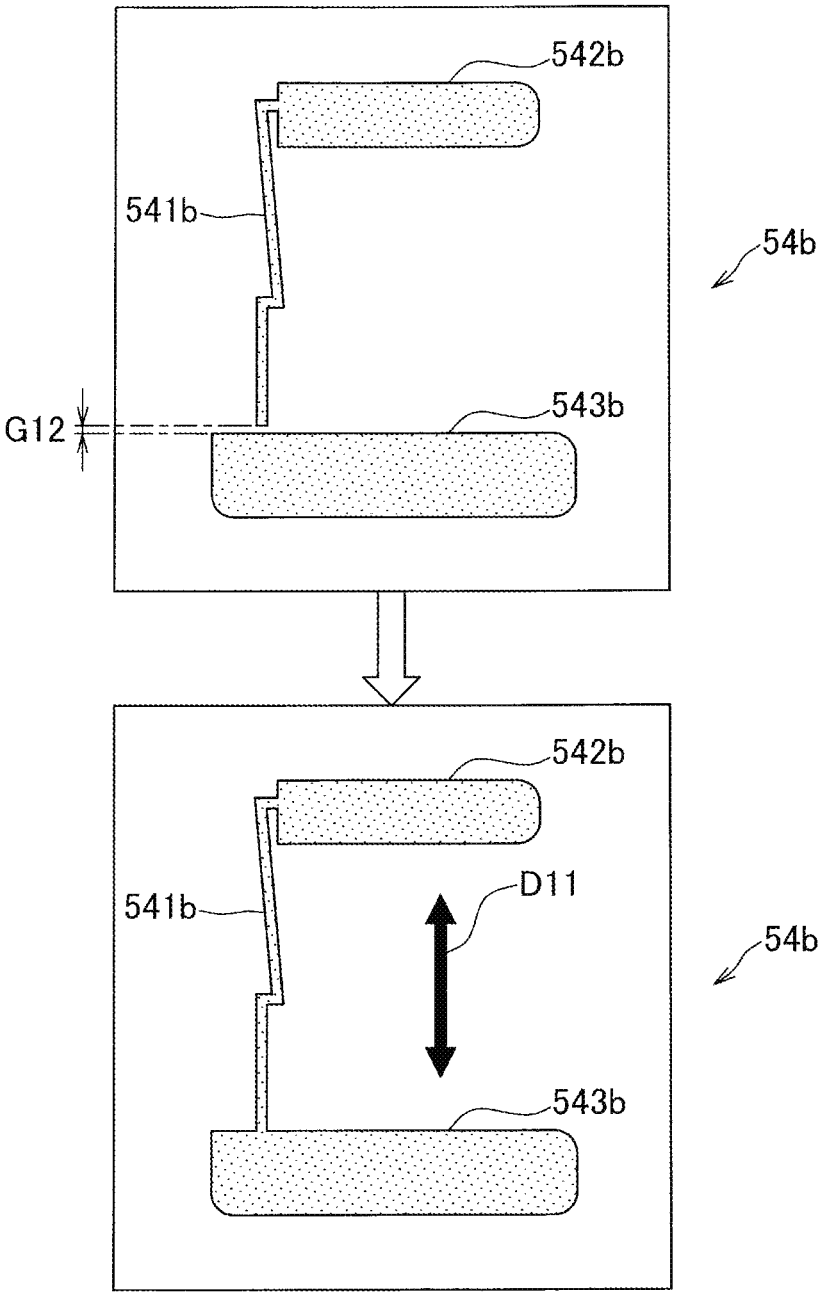
FIG. 18 is a view showing an eighth modification of the embodiment shown in FIGS. 1 to 10.

In the seal member 54*b* in the eighth modification shown in FIG. 18, the third seal portion 543*b* is divided from the first seal portion 541*b*, but the second seal portion 542*b* is connected to the first seal portion 541*b*. The shape of each seal portion is substantially the same as each seal portion of the seal member 14 in the above-described embodiment. In the seal member 54*b* according to the eighth modification, the first seal portion 541*b* is extended in the axial direction D11 that coincides with the length direction thereof during crimping. Due to this extension, the first seal portion 541*b* is connected to the third seal portion 543*b*, and a gap G12 therebetween is blocked.

Figure 19:
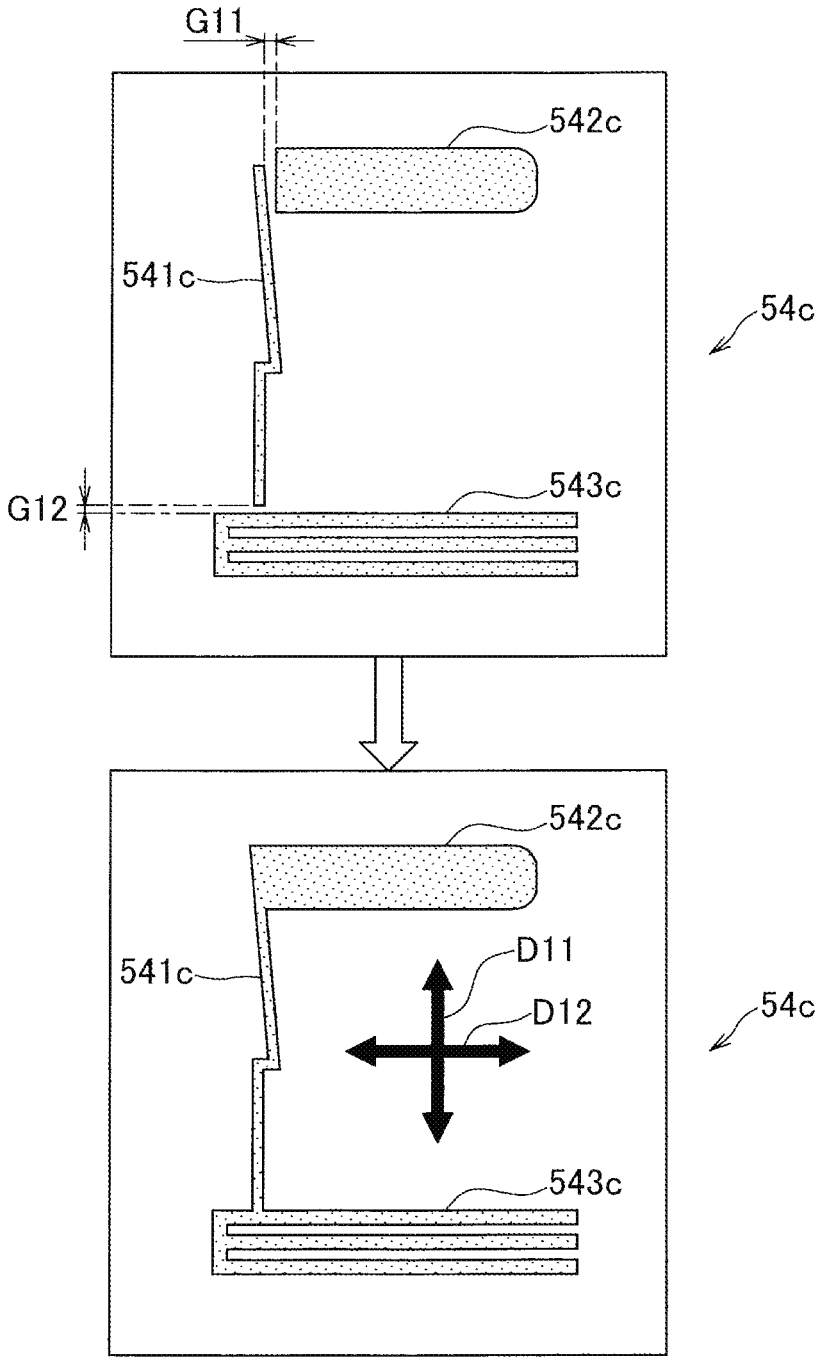
FIG. 19 is a view showing a ninth modification of the embodiment shown in FIGS. 1 to 10.

In the seal member 54*c* in the ninth modification shown in FIG. 19, the third seal portion 543*c* has the following shape. That is, the third seal portion 543*c* is formed in a width and shape corresponding to the groove section 116 in the third region 11*a*-3 shown in FIG. 2. Specifically, the third seal portion 543*c* is formed to have substantially the same width and shape as the groove section 116 so as to be accommodated in the groove section 116. Further, both the second seal portion 542*c* and the third seal portion 543*c* are divided from the first seal portion 541*c*. The shapes of the first seal portion 541*c* and the second seal portion 542*c* are substantially the same as those of the seal member 14 in the above-described embodiment. In the seal member 54*c* according to the ninth modification, the second seal portion 542*c* is extended in the crossing direction D12 that coincides with the length direction thereof during crimping. Due to this extension, the second seal portion 542*c* is connected to the first seal portion 541*c*, and the gap G11 therebetween is blocked. Also, the first seal portion 541*c* is extended in the axial direction D11 that coincides with the length direction thereof. Due to this extension, the first seal portion 541*c* is connected to the third seal portion 543*c*, and the gap G12 therebetween is blocked.

Figure 20:
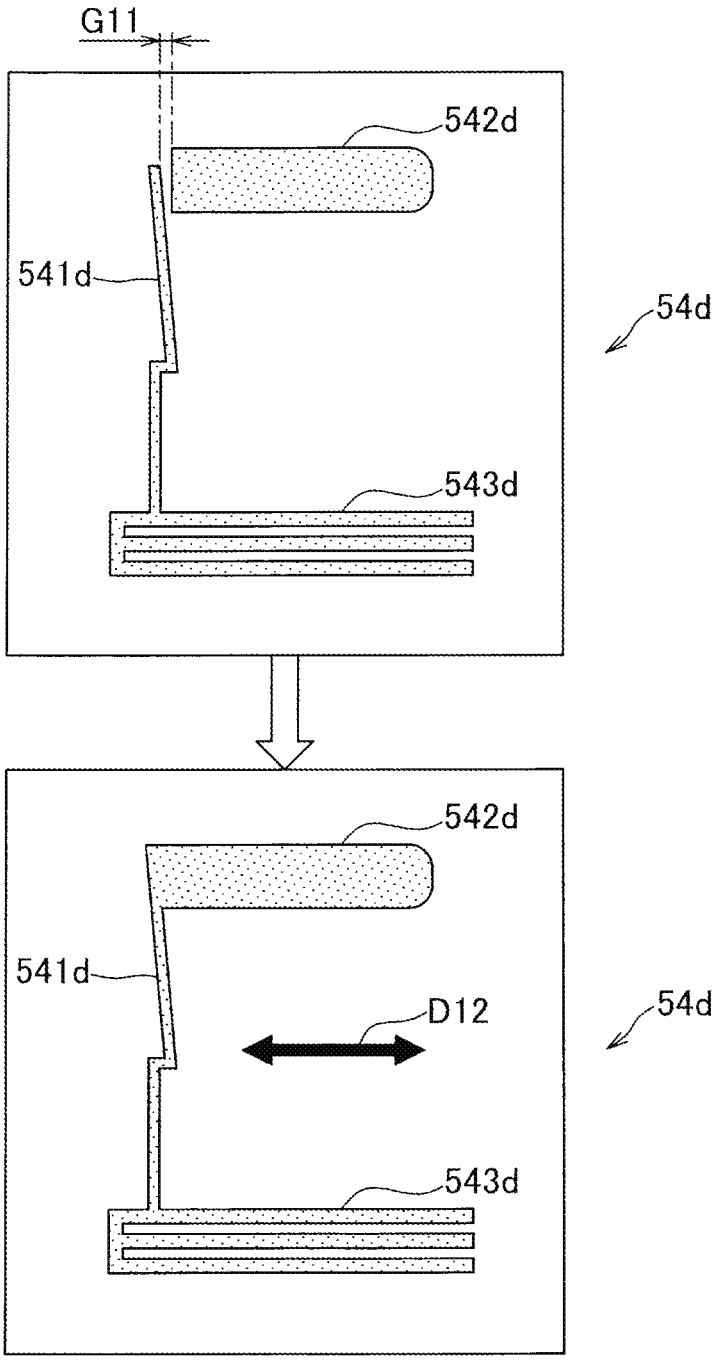
FIG. 20 is a view showing a tenth modification of the embodiment shown in FIGS. 1 to 10.

The seal member 54*d* in the tenth modification shown in FIG. 20 is a further modification of the seal member 54*c* in the ninth modification shown in FIG. 19. That is, in the seal member 54*d* in the tenth modification, the second seal portion 542*d* is divided from the first seal portion 541*d*, but the third seal portion 543*d* is connected to the first seal portion 541*d*. On the other hand, the shape of each seal portion is substantially the same as each seal portion of the seal member 54*c* in the above-described ninth modification. In the seal member 54*d* according to the tenth modification, the second seal portion 542*d* is extended in the crossing direction D12 that coincides with the length direction thereof during crimping. Due to this extension, the second seal portion 542*d* is connected to the first seal portion 541*d*, and the gap G11 therebetween is blocked.

Figure 21:
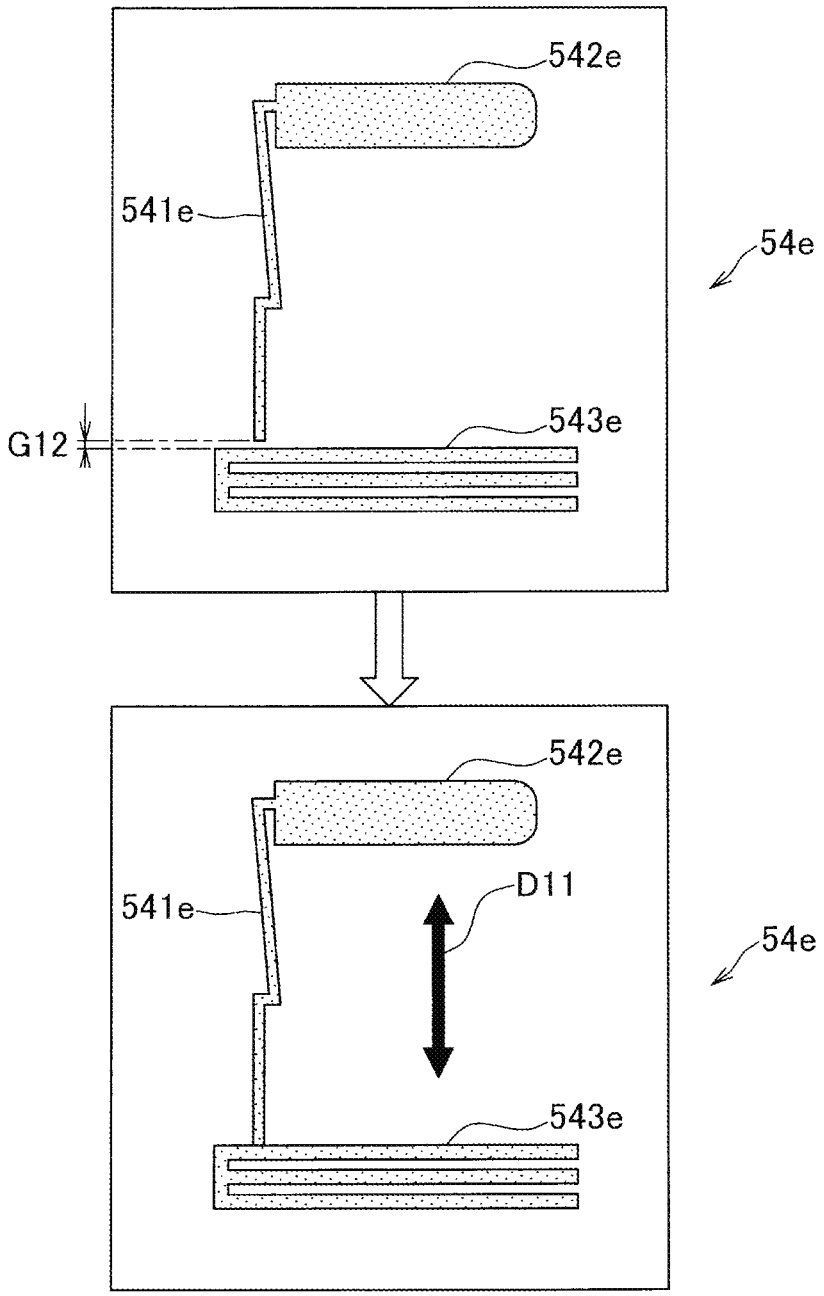
FIG. 21 is a view showing a eleventh modification of the embodiment shown in FIGS. 1 to 10.

The seal member 54*e* in the eleventh modification shown in FIG. 21 is also a further modification of the seal member 54*c* in the ninth modification shown in FIG. 19. That is, in the seal member 54*e* of the eleventh modification, the third seal portion 543*e* is divided from the first seal portion 541*e*, but the second seal portion 542*e* is connected to the first seal portion 541*e*. On the other hand, the shape of each seal portion is substantially the same as each seal portion of the seal member 54*c* in the above-described ninth modification example. In the seal member 54*e* in the eleventh modification, the first seal portion 541*e* is extended in the axial direction D11 that coincides with the length direction thereof during crimping. Due to this extension, the first seal portion 541*e* is connected to the third seal portion 543*e*, and the gap G12 therebetween is blocked.

In any of these seventh to eleventh modifications, the seal members 54*a*, 54*b*, 54*c*, 54*d*, 54*e* are affixed to the barrel section 11 and crimped to the end portion W1*a* of the covered electric wire W1 similar to the above embodiment. As a result, it is needless to say that difficulty in manufacturing can be alleviated while securing waterproofness against the contact portion with the aluminum core wire W11 similar to the above embodiment. In addition, the point that the conductivity can be sufficiently secured and the point that the return of the barrel portion 11 can be satisfactorily suppressed are also the same as the above embodiment.

Further, regarding the ninth to eleventh modifications in which the third seal portions 543*c*, 543*d*, 543*e* are formed in the width and shape corresponding to the groove section 116 in the third region 11*a*-3, it is furthermore possible to obtain the following advantages. According to these ninth to eleventh modifications, each amount of third seal portions 543*c*, 543*d*, and 543*e* is also minimized. As a result, the barrel section 11 is hermetically sealed while further preventing interference of crimping by the sealing members 54*c*, 54*d*, 54*e*, which further alleviates difficulties in manufacturing.

Next, as a twelfth to fourteenth modifications to the above-described embodiment, three modifications to the concave section 114 having a circular shape in a plan view provided on the inner surface 11*a* of the barrel section 11 will be described.

Figure 22:
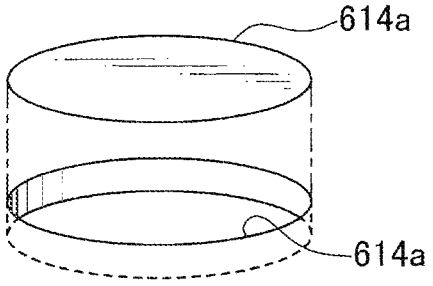
FIG. 22 is a view showing a twelfth modification of the embodiment shown in FIGS. 1 to 10.
Figure 23:
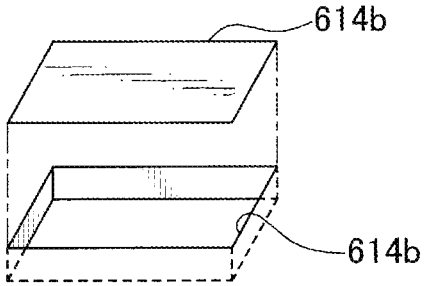
FIG. 23 is a view showing a thirteenth modification of the embodiment shown in FIGS. 1 to 10.
Figure 24:
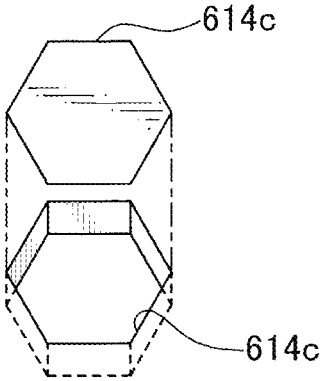
FIG. 24 is a view showing a fourteenth modification of the embodiment shown in FIGS. 1 to 10.

FIG. 22 is a view showing a twelfth modification of the embodiment shown in FIGS. 1 to 10, FIG. 23 is a view showing a thirteenth modification of the embodiment shown in FIGS. 1 to 10, and FIG. 24 is a view showing a fourteenth modification of the embodiment shown in FIGS. 1 to 10.

The concave section 614*a* in the twelfth modification shown in FIG. 22 is formed in an elliptical shape in plan view. In addition, the concave section 614*b* in the thirteenth modification shown in FIG. 20 is formed in a parallelogram in a plan view. Further, the concave section 614*c* in the fourteenth modification shown in FIG. 21 is formed in a hexagonal shape in plan view.

Besides these, as a modification of the concave section 114 in the crimp terminal 1 of the above-described embodiment, a triangle or another polygon in plan view and the like can be presented. In any of these modifications, for example, as compared with a linear groove extending in the crossing direction D12 which may be employed as a conventional serration, the resistance against the force to expand in the in-plane direction of the inner surface 11*a* is strong.

Four modifications of the seal member 14 will be described as fifteenth to eighteenth modifications to the above-described embodiment.

Figure 25:
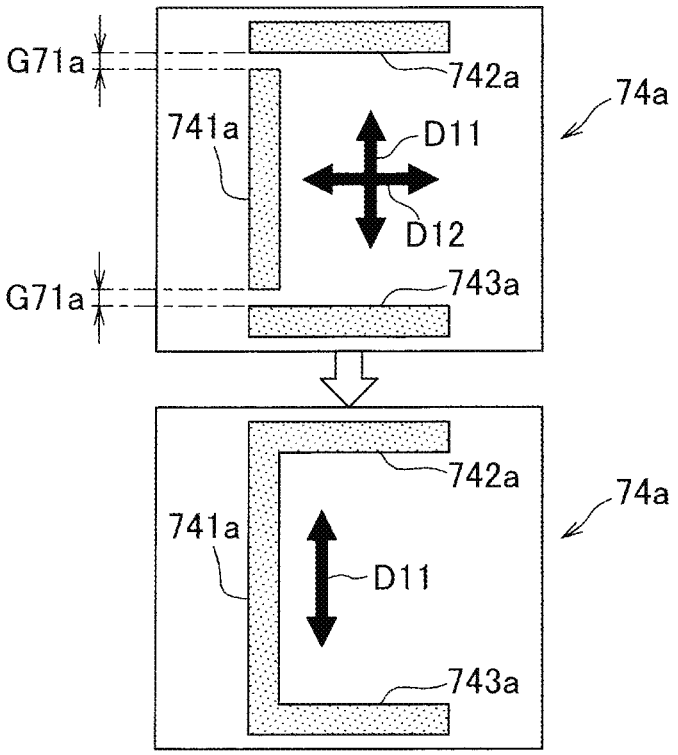
FIG. 25 is a view showing a fifteenth modification of the embodiment shown in FIGS. 1 to 10.

FIG. 25 is a view showing a fifteenth modification of the embodiment shown in FIGS. 1 to 10, FIG. 26 is a view showing a sixteenth modification of the embodiment shown in FIGS. 1 to 10, FIG. 27 is a view showing a seventeenth modification of the embodiment shown in FIGS. 1 to 10, and FIG. 28 is a view showing a eighteenth modification of the embodiment shown in FIGS. 1 to 10.

In the seal member 74*a* of the fifteenth modification shown in FIG. 25, the first seal portion 741*a* is a portion extending in a band shape in the axial direction D11 in the first region 11*a*-1. The second seal portion 742*a* is a portion extending in a band shape in the crossing direction D12 in the second region 11*a*-2. The third seal portion 743*a* is a portion extending in a band shape in the crossing direction D12 in the third region 11*a*-3. Further, both the second seal portion 742*a* and the third seal portion 743*a* are divided from the first seal portion 741*a*. Further, both the second seal portion 742*a* and the third seal portion 743*a* are divided from the first seal portion 741*a* by a gap G71*a* crossing the path 11*a*-4 shown in FIG. 2 in the crossing direction D12. The first seal portion 741*a*, the second seal portion 742*a*, and the third seal portion 743*a* are affixed to the barrel section 11 so as to overlap with the groove section 116. In the seal member 74*a* in the fifteenth modification, the first seal portion 741*a* is extended in the axial direction D11 that coincides with the length direction thereof during crimping. Due to this extension, the first seal portion 741*a* is connected to both the second seal portion 742*a* and the third seal portion 743*a*, and each gap G71*a* is blocked.

Figure 26:
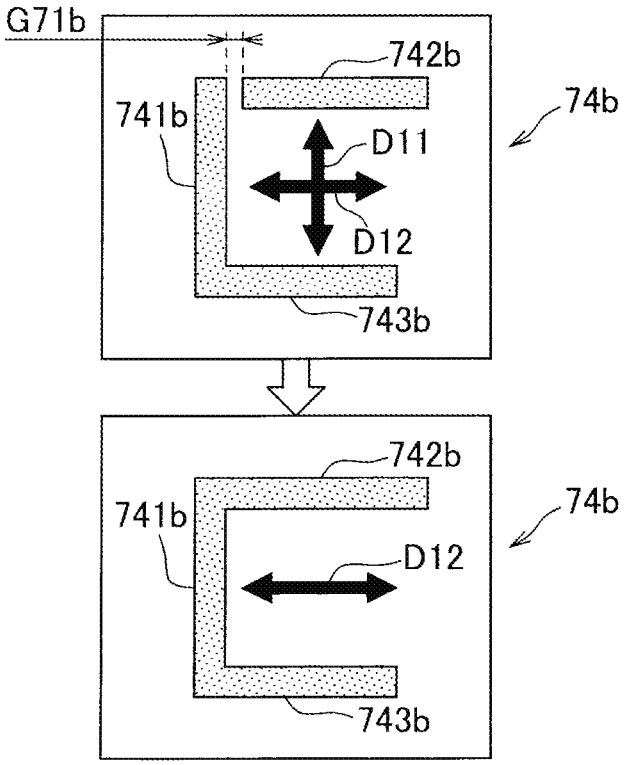
FIG. 26 is a view showing a sixteenth modification of the embodiment shown in FIGS. 1 to 10.

The seal member 74*b* in the sixteenth modification shown in FIG. 26 is a further modification of the seal member 74*a* in the fifteenth modification shown in FIG. 25. That is, in the seal member 74*b* of the sixteenth modification, the second seal portion 742*b* is divided from the first seal portion 741*b*, but the third seal portion 743*b* is connected to the first seal portion 741*b*. Further, in the sixteenth modification, the second seal portion 742*b* is divided from the first seal portion 741*b* by a gap G71*b* across the path 11*a*-4 in the axial direction D11. In the seal member 74*b* according to the sixteenth modification, the second seal portion 742*b* is extended in the crossing direction D12 that coincides with the length direction thereof during the crimping. Due to this extension, the second seal portion 742*b* is connected to the first seal portion 741*b*, and the gap G71*b* therebetween is blocked.

Figure 27:
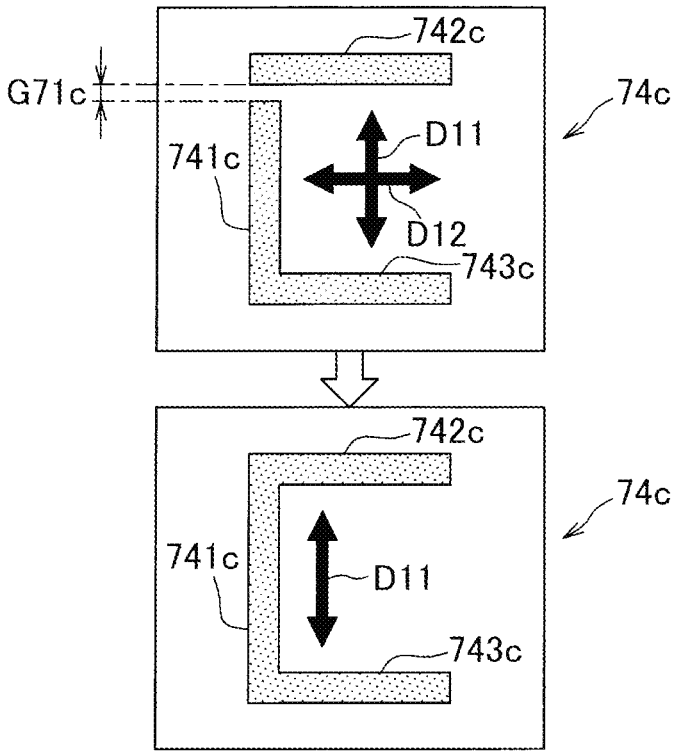
FIG. 27 is a view showing a seventeenth modification of the embodiment shown in FIGS. 1 to 10.

The seal member 74*c* in the seventeenth modification shown in FIG. 27 is also a further modification of the seal member 74*b* in the fifteenth modification shown in FIG. 25. That is, in the seal member 74*c* of the seventeenth modification, the second seal portion 742*c* is divided from the first seal portion 741*c*, but the third seal portion 743*c* is connected to the first seal portion 741*c*. Further, in the seventeenth modification, the second seal portion 742*c* is divided from the first seal portion 741*c* by a gap G71*c* across the path 11*a*-4 in the crossing direction D12. In the seal member 74*c* according to the sixteenth modification, the first seal portion 741*c* is extended in the axial direction D11 during crimping. Due to this extension, the first seal portion 741*c* is connected to the second seal portion 742*c*, and the gap G71*c* therebetween is blocked.

Figure 28:
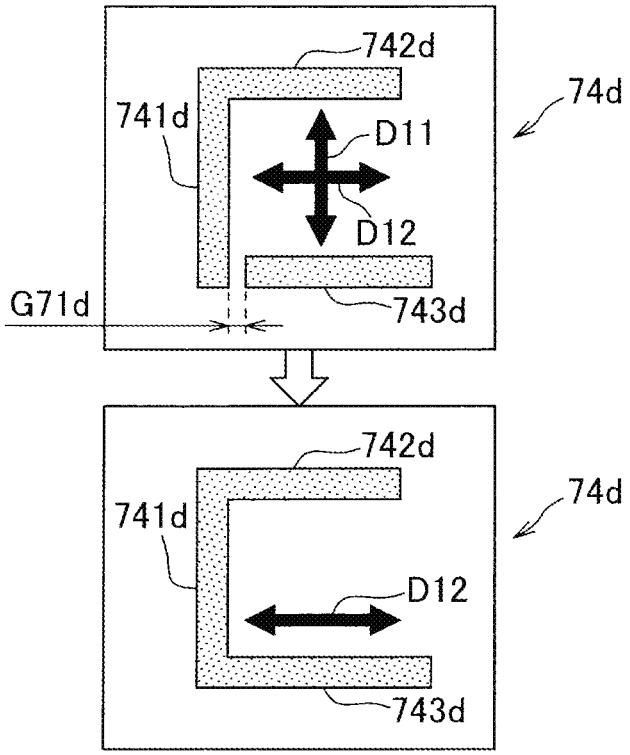
FIG. 28 is a view showing a eighteenth modification of the embodiment shown in FIGS. 1 to 10.
Figure 29:
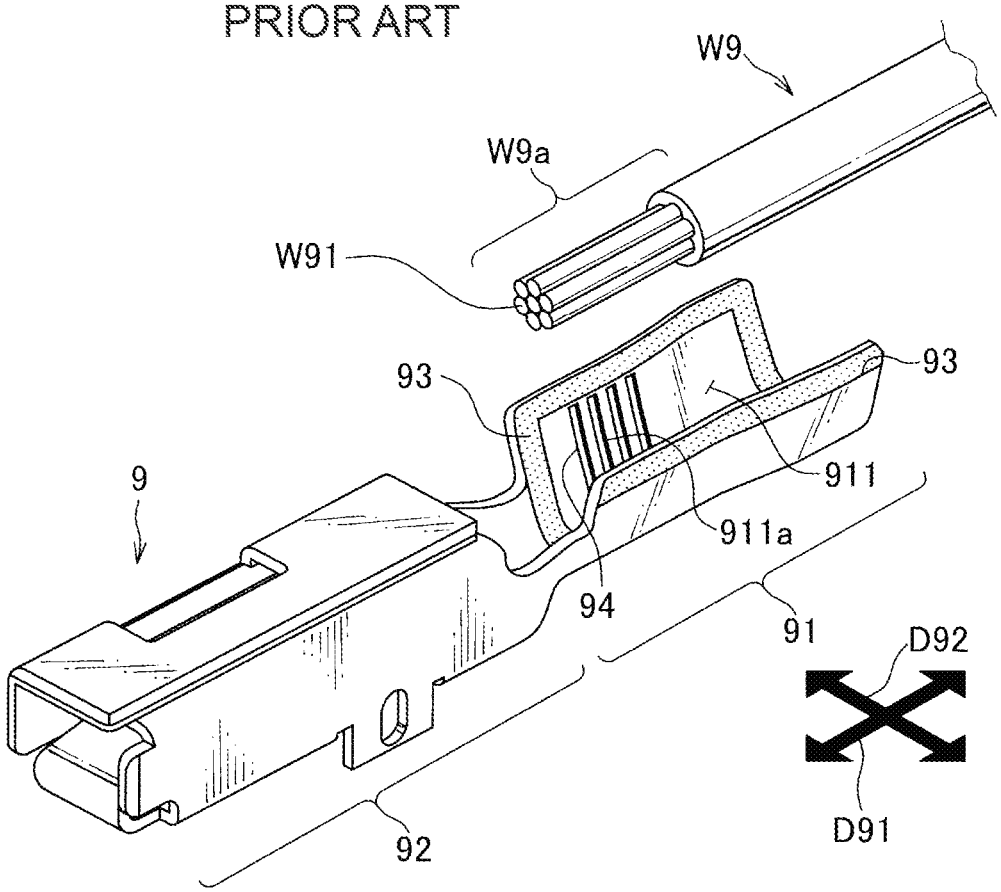
FIG. 29 PRIOR ART
FIG. 29 is a view showing an example of a conventional crimp terminal surrounding a contact portion between a barrel section and an aluminum core wire with a seal member.

The sealing member 74*d* in the eighteenth modification shown in FIG. 28 is also a further modification of the sealing member 74*b* in the fifteenth modification shown in FIG. 25. That is, in the seal member 74*d* of the eighteenth modification, the third seal portion 743*d* is divided from the first seal portion 741*d*, but the second seal portion 742*d* is connected to the first seal portion 741*d*. Further, in the eighteenth modification, the third seal portion 743*d* is divided from the first seal portion 741*d* by a gap G71*d* traversing the path 11*a*-4 in the axial direction D11. In the seal member 74*d* in the sixteenth modification, the third seal portion 743*d* is extended in the crossing direction D12 during crimping. Due to this extension, the third seal portion 743*d* is connected to the first seal portion 741*d*, and the gap G71*d* therebetween is blocked.

Compared with the fifteenth to the eighteenth modifications, in the above-described embodiment, the first seal portion 141 is formed in a width and a shape corresponding to the groove section 116, and the amount thereof is suppressed, so that manufacturing difficulties can be alleviated as described above.

On the other hand, also in these fifteenth to eighteenth modifications, for example, as shown in FIG. 5, it goes without saying that by crimping to the covered electric wire W1, it is possible to sufficiently secure the conductivity, and the return of the barrel section 31 can be well suppressed similar to the above-described embodiment.

It is to be noted that the above-described embodiment merely shows a representative form of the present invention, and the present invention is not limited to this embodiment. That is, various modifications can be made without departing from the gist of the present invention. As long as the configuration of the present invention is still provided by such modification, it is of course within the scope of the present invention.

For example, in the above-described embodiment and various modified examples, a mode in which a convex section is provided on the barrel section by press working from the outer surface side is exemplified. However, the barrel section is not limited to this form, and the convex section may be omitted. However, as described above, by providing the convex section, it is possible to increase the number of contacts with the barrel section by spreading the strands of the aluminum core wire.

Further, in each of the above-described embodiments and the various modifications, as one example of the terminal section, a crimp terminal having a terminal section 12 as a female terminal in a square tubular shape is exemplified. However, the terminal section is not limited to this, and does not require any specific shape or connection mode.

REFERENCE SIGNS LIST

1, 2, 3, 4*a*, 4*b*, 4*c* Crimp terminal
11, 21, 31, 41 Barrel section
11*a*, 31*a*, 41*a* Inner surface
11*a*-1, 41*a*-1 First region
11*a*-2, 41*a*-2 Second region
11*a*-3, 41*a*-3 Third region
11*a*-4, 41*a*-4 Path
12 Terminal section
14, 54*a*, 54*b*, 54*c*, 54*d*, 54*e*, 74*a*, 74*b*, 74*c*, 74*d* Sealing member
111 Bottom plate section
112 Inner barrel piece
113 Outer barrel piece
114, 614*a*, 614*b*, 614*c* Concave section
115 Convex section
116, 416*a*, 416*b*, 416*c* Groove section
117*a* first indent portion (ridge portion)
117*b* second indent portion (second ridge portion)
141, 541*a*, 541*b*, 541*c*, 541*d*, 541*e*, 741*a*, 741*b*, 741*c*, 741*d* *First seal portion*
142, 542*a*, 542*b*, 542*c*, 542*d*, 542*e*, 742*a*, 742*b*, 742*c*, 742*d* *Second seal portion*
143, 543*a*, 543*b*, 543*c*, 543*d*, 543*e*, 743*a*, 743*b*, 743*c*, 743*d* *Third seal portion*
D11 Axial direction
D12 Crossing direction
G11, G12, G71*a*, G71*b*, G71*c*, G71*d* Gap
W1 Covered electric wire
W1*a* End portion
W11 Aluminum core wire
W11*a* Tip end
W12 Covered portion
W12*a* Tip end
TW1, TWH1, TWH2, TWH3 wire with terminal

The invention claimed is:

1. A crimp terminal configured to be connected to an electric wire, the crimp terminal including:

a barrel section configured to be wound around and crimped to an end portion of a covered electric wire having an aluminum core wire at which the aluminum core wire is exposed, and a terminal section configured to be connected to a connection object, wherein the barrel section and the terminal section are arranged in a predetermined axial direction, wherein the barrel section includes: a bottom plate section extending in the axial direction, on which the end portion of the covered electric wire is to be placed, an inner barrel piece, and an outer barrel piece, the inner barrel piece and the outer barrel piece extending from the bottom plate section on both sides thereof in a crossing direction and intersecting the axial direction in a plan view with respect to the bottom plate section, wherein the crimp terminal includes a sealing member, formed of an adhesive gel affixed across first through third regions of the barrel section, the first region of the barrel section longitudinally traversing the outer barrel piece in the axial direction, the second region of the barrel section traversing an inner surface of the barrel section in the crossing direction at a position close to the terminal section, and the third region of the barrel section traversing the inner surface of the barrel section in the crossing direction so as to intersect a covered portion of the end portion of the covered electric wire, wherein a plurality of concave sections, formed in a substantially circular, elliptical, or polygon shape in a plan view, is dispersedly provided on the inner surface of the barrel section, a groove section is provided on at least the third region of the barrel section so as to overlap the sealing member, and a ridge portion is provided extending in the crossing direction at a position which does not overlap with the sealing member in the plan view and is close to the third region of the barrel section, wherein the barrel section is crimped to the end portion of the covered electric wire so that the exposed portion of the aluminum core wire at the end portion is in contact with the ridge portion, and the sealing member seals between the inner barrel piece and the outer barrel piece, an opening of the barrel section which is to be cylindrical on a side of the terminal section, and between the covered portion and the barrel section.

2. The crimp terminal configured to be connected to an electric wire as claimed in claim 1, wherein the inner surface of the barrel section is further provided with a second ridge portion extending in the crossing direction at a position close to the terminal section.

3. The crimp terminal configured to be connected to an electric wire as claimed in claim 1, wherein the barrel section is crimped to the end portion so that a tip of the covered portion at the end portion overlaps a portion of the sealing member affixed to the third region of the barrel section.

4. The crimp terminal configured to be connected to an electric wire as claimed in claim 1, wherein the groove section is also provided on the first region of the barrel section so as to overlap the sealing member, and wherein in the seal member, a first seal portion affixed to the first region of the barrel section is narrower than a second seal portion affixed to the second region of the barrel section, and the first seal portion is formed in a shape corresponding to the groove section in the first region of the barrel section.

5. A terminal connection method for connecting a crimp terminal to an end portion of a covered electric wire to obtain the crimp terminal configured to be connected to an electric wire as claimed in claim 1, the method comprising:

a placing step of placing the end portion on the inner surface of the barrel section along the axial direction so that the exposed portion of the aluminum core wire at the end portion is in contact with the ridge portion; and a crimping step of fixing the crimp terminal to the end portion by winding the barrel section around the end portion with the inner barrel piece arranged inside , and sealing between the inner barrel piece and the outer barrel piece, the opening of the barrel section which is to be cylindrical on the side of the terminal section, and between the covered portion and the barrel section with the sealing member.

6. The terminal connection method as claimed in claim 5, wherein the placing step is a step of placing the end portion on the inner surface of the barrel section so that a tip of the covered portion at the end portion overlaps with a portion of the sealing member affixed to the third region of the barrel section.

7. The terminal connection method as claimed in claim 5, wherein the groove section is also provided on the first region so as to overlap the sealing member, and wherein in the seal member, a first seal portion affixed to the first region of the barrel section is affixed so as to be accommodated inside the groove section in the first region of the barrel section.

* * * * *